US008881636B2

(12) United States Patent
Hyde et al.

(10) Patent No.: US 8,881,636 B2
(45) Date of Patent: Nov. 11, 2014

(54) SYSTEMS AND METHODS FOR DEFLECTING OBJECTS WITH ROCKET EXHAUST

(71) Applicant: Elwha LLC, Bellevue, WA (US)

(72) Inventors: Roderick A. Hyde, Redmond, WA (US); Lowell L. Wood, Jr., Bellevue, WA (US)

(73) Assignee: ELWHA LLC, Bellevue, WA (US)

( * ) Notice: Subject to any disclaimer, the term of this patent is extended or adjusted under 35 U.S.C. 154(b) by 0 days.

(21) Appl. No.: 13/623,028

(22) Filed: Sep. 19, 2012

(65) Prior Publication Data

US 2014/0076142 A1 Mar. 20, 2014

(51) Int. Cl.
*F41H 5/007* (2006.01)

(52) U.S. Cl.
CPC ..... *F41H 5/007* (2013.01)
USPC ..... 89/1.11; 89/36.08; 89/36.17; 89/902

(58) Field of Classification Search
USPC ..... 89/1.11, 36.01, 36.03, 36.04, 36.08, 89/36.11, 36.12, 36.17, 902
See application file for complete search history.

(56) References Cited

U.S. PATENT DOCUMENTS 3,592,148 A * 7/1971 Manis ..... 109/37
4,051,763 A * 10/1977 Thomanek ..... 89/36.17
5,001,984 A * 3/1991 Jones et al. ..... 102/418
5,400,688 A * 3/1995 Eninger et al. ..... 89/1.11
5,714,711 A * 2/1998 Schumacher et al. ..... 102/291
5,915,291 A * 6/1999 Weihrauch et al. ..... 89/36.01
6,327,955 B1 * 12/2001 Kerdraon et al. ..... 89/36.17
7,077,049 B2 * 7/2006 Shumov et al. ..... 89/36.17
7,202,809 B1 * 4/2007 Schade et al. ..... 342/67
7,387,060 B1 * 6/2008 Sanford ..... 89/1.11
8,281,701 B2 * 10/2012 Zank et al. ..... 89/36.17
8,444,785 B2 * 5/2013 Hugus et al. ..... 149/37
8,490,538 B2 * 7/2013 Tawil ..... 89/36.17
8,596,178 B2 * 12/2013 Rogers et al. ..... 89/1.11
2004/0056792 A1 * 3/2004 Miron ..... 342/52
2004/0237762 A1 * 12/2004 O'Dwyer ..... 89/1.11
2006/0225566 A1 * 10/2006 Lloyd ..... 89/36.17
2007/0272797 A1 11/2007 Skurkovich et al.
2009/0158954 A1 6/2009 Wardecki et al.
2012/0048103 A1 * 3/2012 Beach et al. ..... 89/36.17
2012/0192707 A1 * 8/2012 Rogers et al. ..... 89/36.08
2012/0312149 A1 * 12/2012 Marscher et al. ..... 89/1.11
2013/0092016 A1 * 4/2013 Sales ..... 89/36.08
2013/0125656 A1 * 5/2013 Tillotson et al. ..... 73/599
2013/0239835 A1 * 9/2013 Tillotson et al. ..... 102/215

* cited by examiner

*Primary Examiner* — Bret Hayes
*Assistant Examiner* — Derrick Morgan

(57) ABSTRACT

According to one embodiment, a system for protecting a vehicle from projectiles includes a detection component, a selection component, and an ignition component. In one embodiment, the detection component detects one or more projectiles having a first trajectory that is incident to a first location on the vehicle. In one embodiment, the selection component automatically selects two or more rockets mounted on the vehicle that, when ignited, produce a plurality of exhaust streams configured to deflect the one or more projectiles to a second trajectory. In one embodiment, the second trajectory is not incident to the first location on the vehicle. In one embodiment, the ignition component ignites the selected two or more rockets.

31 Claims, 24 Drawing Sheets

SYSTEMS AND METHODS FOR DEFLECTING OBJECTS WITH ROCKET EXHAUST

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application is related to and/or claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

NONE

RELATED APPLICATIONS

U.S. patent application Ser. No. 13/623,033, entitled SYSTEMS AND METHODS FOR DEFLECTING OBJECTS WITH ROCKET EXHAUST, naming Roderick A. Hyde and Lowell L. Wood, Jr. as inventors, filed 19 Sep. 2012, is related to the present application.

The United States Patent Office (USPTO) has published a notice to the effect that the USPTO's computer programs require that patent applicants reference both a serial number and indicate whether an application is a continuation, continuation-in-part, or divisional of a parent application. Stephen G. Kunin, *Benefit of Prior-Filed Application*, USPTO Official Gazette Mar. 18, 2003. The USPTO further has provided forms for the Application Data Sheet which allow automatic loading of bibliographic data but which require identification of each application as a continuation, continuation-in-part, or divisional of a parent application. The present Applicant Entity (hereinafter "Applicant") has provided above a specific reference to the application(s) from which priority is being claimed as recited by statute. Applicant understands that the statute is unambiguous in its specific reference language and does not require either a serial number or any characterization, such as "continuation" or "continuation-in-part," for claiming priority to U.S. patent applications. Notwithstanding the foregoing, Applicant understands that the USPTO's computer programs have certain data entry requirements, and hence Applicant has provided designation(s) of a relationship between the present application and its parent application(s) as set forth above and in any ADS filed in this application, but expressly points out that such designation(s) are not to be construed in any way as any type of commentary and/or admission as to whether or not the present application contains any new matter in addition to the matter of its parent application(s).

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

TECHNICAL FIELD

This disclosure relates to deflecting objects from impacting targets and more specifically relates to deflecting projectiles with rocket exhaust.

SUMMARY

A system, method, and computer readable storage medium for protecting a target from projectiles is disclosed. According to one embodiment, a system for protecting a vehicle from projectiles includes a detection component, a selection component, and an ignition component. In one embodiment, the detection component detects one or more projectiles having a first trajectory that is incident to a first location on the vehicle. In one embodiment, the selection component automatically selects two or more rockets mounted on the vehicle that, when ignited, produce a plurality of exhaust streams configured to deflect the one or more projectiles to a second trajectory. In one embodiment, the second trajectory is not incident to the first location on the vehicle. In one embodiment, the ignition component ignites the selected two or more rockets.

DETAILED DESCRIPTION

Figure 1:
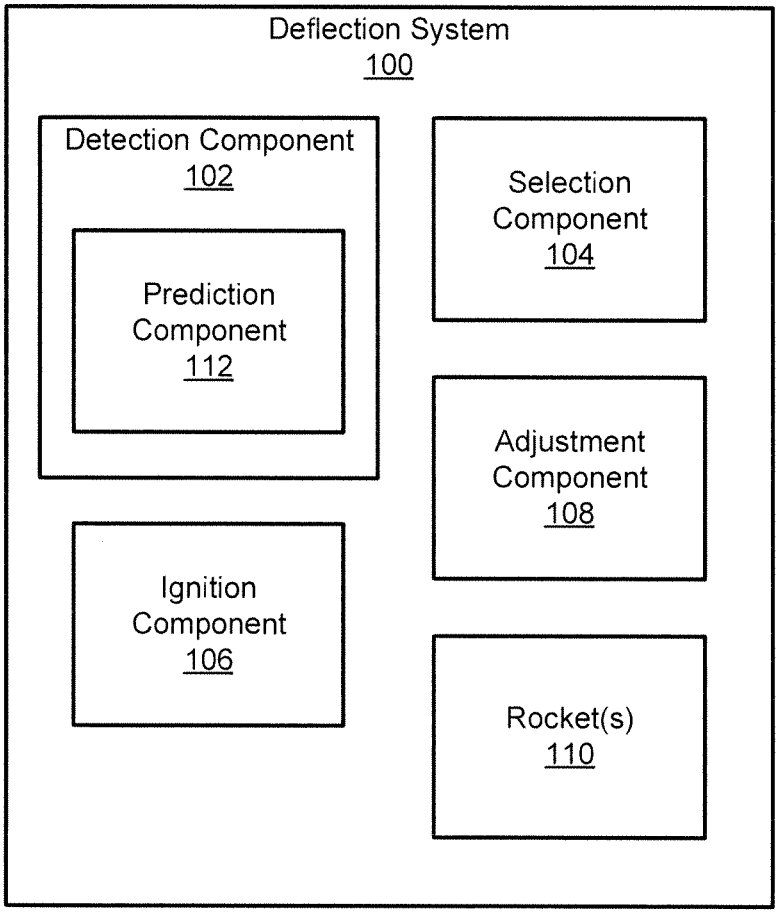
FIG. 1 is a block diagram illustrating components of a deflection system according to one embodiment.

Transport of personnel and goods through hostile regions is an important part of many security, peace-keeping, and military operations. Military personnel, for example, may patrol roadways, border regions, or cities in Humvees or other vehicles to observe conditions and/or protect from opposing or insurgent forces. Often these personnel will come under attack while traveling within their vehicles. For example, car bombs, improvised explosive devices (IEDs), rocket propelled grenades, or other explosive devices or projectiles may be used to damage a vehicle or harm its occupants. IEDs and other explosive devices often create shrapnel and clouds of debris that can be particularly dangerous. Similarly, attacks on tanks, boats, aircraft, buildings, or other targets may also occur.

One way to protect from explosive devices, warheads, projectiles, or other attacks includes the use of armor. Armor may include thick, hard, and/or resilient material that covers portions of a vehicle or target. However, armor can be extremely heavy and/or expensive. Furthermore, armor does nothing to avoid impact with incoming objects and thus is vulnerable to projectiles and warheads designed to pierce armor. In some instances avoiding impact may be done by firing a missile or other projectile to intercept an incoming warhead long before it hits a target. For example, a missile may be launched to intercept an incoming missile from hundreds of feet to miles away from the target. However, this method of intercepting objects is extremely expensive and is generally ineffective or difficult to implement against smaller projectiles, debris clouds, and/or projectiles that originate at close ranges to a target.

In view of the foregoing, Applicants have recognized that a need exists for alternative systems and methods for deflecting objects. Applicants herein disclose methods and systems for deflecting objects with rocket exhaust. As used herein, the term "rocket" is broadly defined as a device that emits an explosive high velocity stream of exhaust through a nozzle or other outlet by igniting a fuel source, such as a solid or liquid fuel. Thus, the term rocket is not intended to be limited to cylindrical projectile weapons that launch into their air. Indeed, in the primary embodiments disclosed herein, the rockets are fixedly mounted on or near a target, such as a vehicle, and are used to create exhaust streams that deflect incoming projectiles and divert them from impacting the target or a sensitive area of the target. Although the following disclosure refers particularly to vehicles, those skilled in the art will recognize that the principles disclosed herein are applicable to a wide variety of targets. As used herein the term "projectile" is given to mean any high velocity objects resulting from firing of a weapon or triggering of an explosion. Examples of projectiles include bullets, shrapnel, debris clouds, rocket propelled grenades (RPGs), explosive warheads, or the like.

In one embodiment, a system for deflecting rocket exhaust detects incoming projectiles that may be incident to a target. The system may predict a trajectory of the incoming projectiles and whether or not it will impact the target or a sensitive area of the target. In one embodiment, the system selects one or more rockets that, when ignited, will create an exhaust stream affecting the trajectory of the incoming projectiles. The system may ignite one or more rockets, such as the selected rockets, to create exhaust streams that impact and deflect the incoming projectiles. In one embodiment, the system adjusts the exhaust streams such that the incoming projectiles will be deflected or will be more effectively deflected. For example, the system may adjust a direction, flow rate, or a divergence of an exhaust stream to more effectively alter a trajectory of an incoming projectile.

Referring now to the figures, FIG. 1 is a block diagram illustrating various components of one embodiment of a deflection system 100. The deflection system 100 may be used to deflect incoming projectiles or other objects from impacting a target or a sensitive portion of a target. In one embodiment, the deflection system 100 includes a detection component 102, a selection component 104, an ignition component 106, an adjustment component 108, and one or more rockets 110.

In operation, the detection component 102 may detect one or more projectiles having a first trajectory that is incident to a first location on the vehicle. The detection component 102 may include a prediction component 112 that predicts a trajectory of a detected projectile or group of projectiles. The selection component 104 may automatically select two or more rockets 110 mounted on the vehicle for ignition to deflect a detected projectile. In one embodiment, the rockets 110, when ignited, produce exhaust streams that deflect one or more projectiles. The ignition component 106 may ignite the rockets 110 selected by the selection component 104. The adjustment component 108 may adjust an exhaust stream to deflect the projectile(s). For example, the adjustment component 108 may adjust a direction, flow rate, or a divergence of an exhaust stream to more effectively alter a trajectory of an incoming projectile.

The components 102-112 are provided by way of example only and may not be included in all embodiments. For example, varying embodiments may include any one or a combination of any two or more of the components 102-112, without limitation. According to one embodiment, the deflection system 100 does not include a selection component 104. For example, where only a single rocket 110 is included a selection component 104 may or may not be needed. In another embodiment, the deflection system 100 does not include the adjustment component 108 where adjustment of the exhaust streams is not needed.

Figure 2:
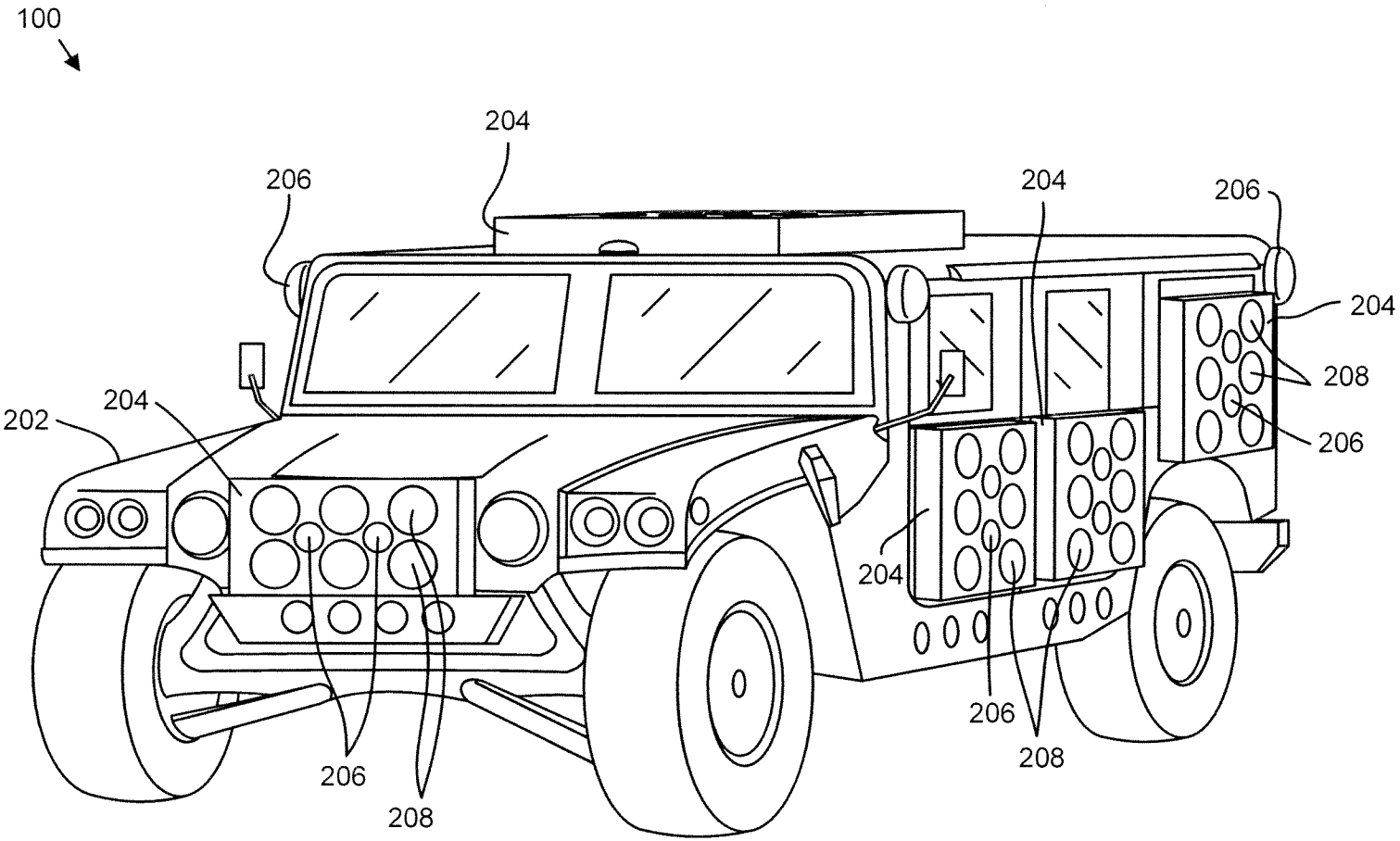
FIG. 2 is a perspective view illustrating one embodiment of a deflection system mounted on a vehicle.
Figure 3:
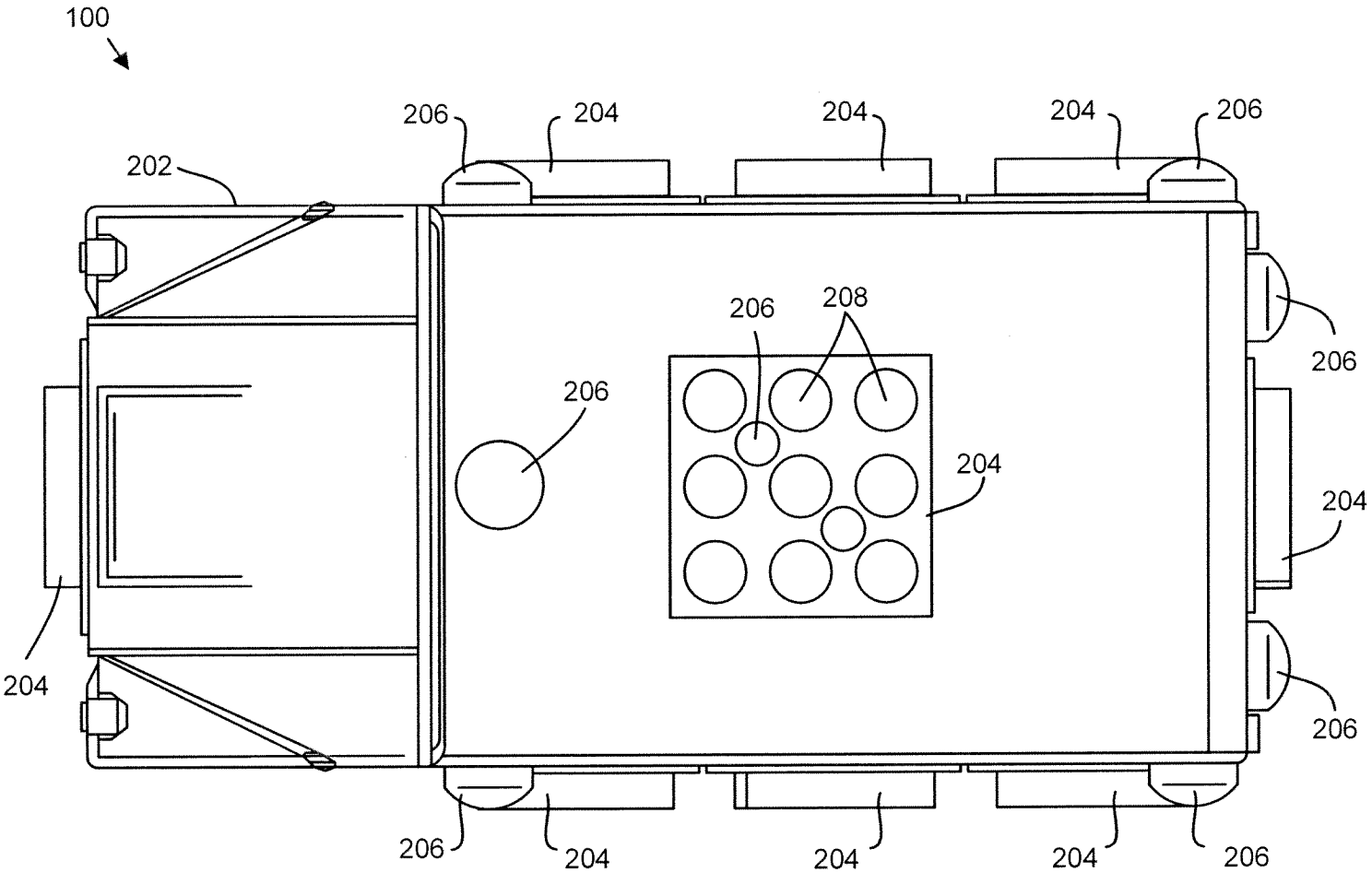
FIG. 3 is a top view of the deflection system of FIG. 2.

FIGS. 2-5 illustrate embodiments of vehicle mounted deflection systems 100. FIG. 2 is a perspective view illustrating one embodiment of a deflection system 100 mounted on a vehicle 202. FIG. 3 is a top view of the deflection system 100 and vehicle 202 of FIG. 2. In one embodiment, the deflection system 100 includes a plurality of panels 204 and detectors 206 which have been mounted to the vehicle. In one embodiment, the panels 204 include one or more rocket compartments 208. The panels 204 may also include detectors 206. In one embodiment, the various components 102-112 of the deflection system 100 are be built into and/or distributed throughout the panels 204, detectors 206, and/or vehicle 202.

In one embodiment, the deflection system 100 is be mounted on a land vehicle, such as that depicted in FIGS. 2-5. The vehicle 202 may include a military vehicle, such as a humvee, jeep, tank, or other vehicle. The vehicle 202 may have locations that are more sensitive or susceptible to an attack. For example, the passenger compartment where personnel are seated may have a particular need to be protected from incoming projectiles. Alternatively or in addition, an engine compartment or cargo compartment may require protection. In one embodiment, some portions of the vehicle 202 have less armor and, therefore, may be in greater need of protection from incoming projectiles. Although the deflection system 100 is depicted as mounted on a land vehicle 202, some embodiments of deflection systems are configured to be mounted or built into any type of land vehicle, water vehicle, or air vehicle. Additionally, some embodiments of deflection systems are configured to protect a fixed location, such as a geographic location or a building, from projectiles.

In one embodiment, the deflection system 100 includes detectors 206, which include one or more sensors for detecting projectiles and/or explosion events. Detectors may include cameras, light detection and ranging (lidar) units, radar units, antennas, or the like. In one embodiment, the detectors 206 are distributed around the vehicle 202 so that projectiles and explosion events may be detected from any direction or angle. For example, detectors may be placed on the top, bottom, front, rear, and/or sides of a vehicle. The detectors 206 may be located within the panels 204 and/or separate from the panels 204.

The deflection system 100 may include rocket compartments 208 to house the rockets 110. Each rocket compartment 208 may include one or more rockets 110.

The rocket(s) 110 and/or mechanisms within the compartments may facilitate adjustment of an exhaust stream. For example, the exhaust streams produced by rockets 110 within the rocket compartments 208 may be adjustable in direction, flow rate, and/or divergence. In another embodiment, the rocket(s) 110 within the rocket compartments 208 are not adjustable and have a fixed direction, flow rate, and/or divergence.

Figure 4:
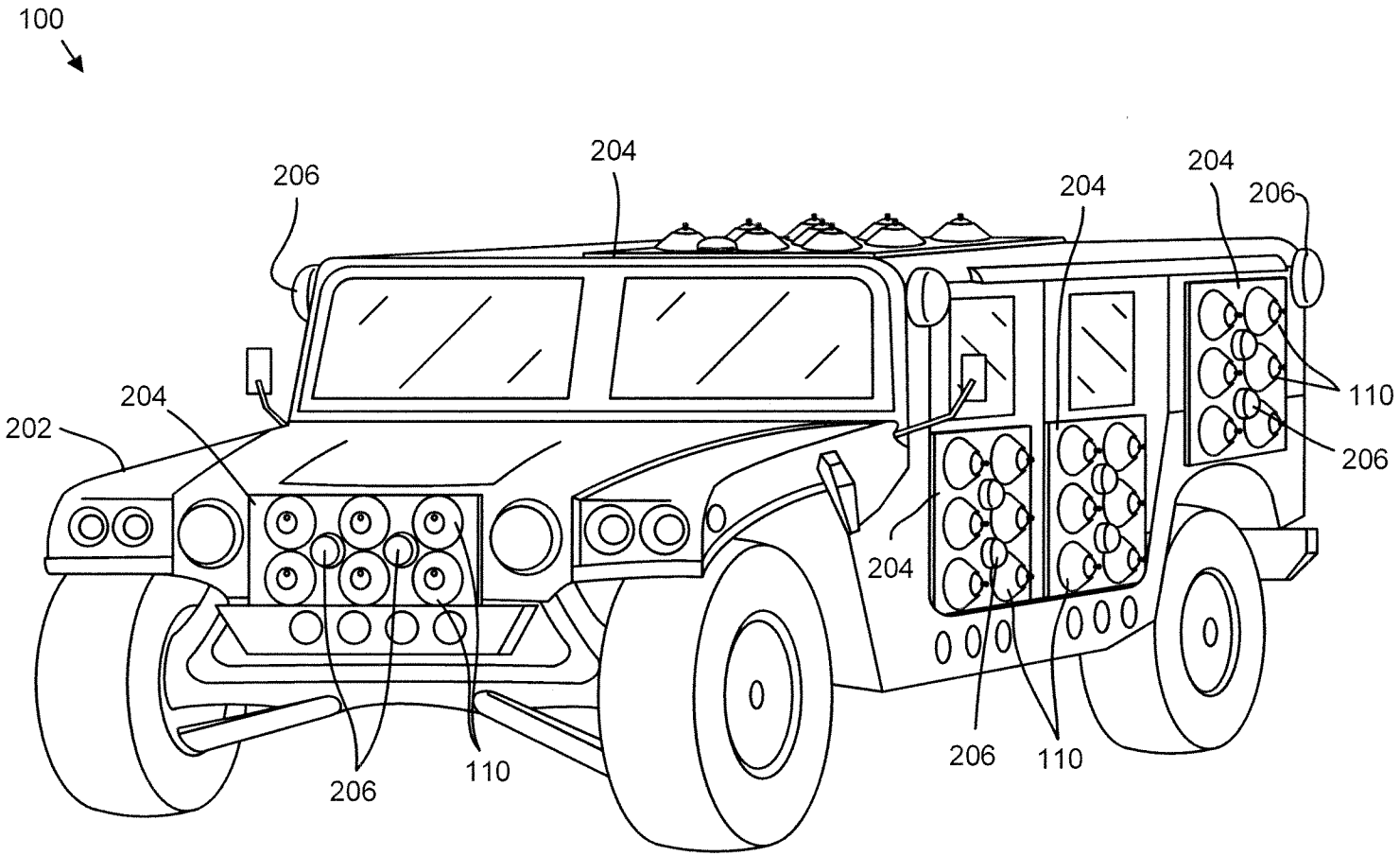
FIG. 4 is a perspective view illustrating another embodiment of a deflection system mounted on a vehicle.

FIG. 4 is a perspective view of another embodiment of a deflection system 100 mounted on a vehicle 202. Similar to the deflection system 100 of FIGS. 2-3, the deflection system 100 of FIG. 4 includes panels 204 and detectors 206. However, the panels 204 include rockets 110 and detectors 206 mounted on a surface of the panels 204 rather than within compartments. Additionally, the rockets 110 are depicted as being adjustable rockets that are capable of pointing in a variety of directions. Adjustable rockets will be discussed in greater detail below.

Figure 5:
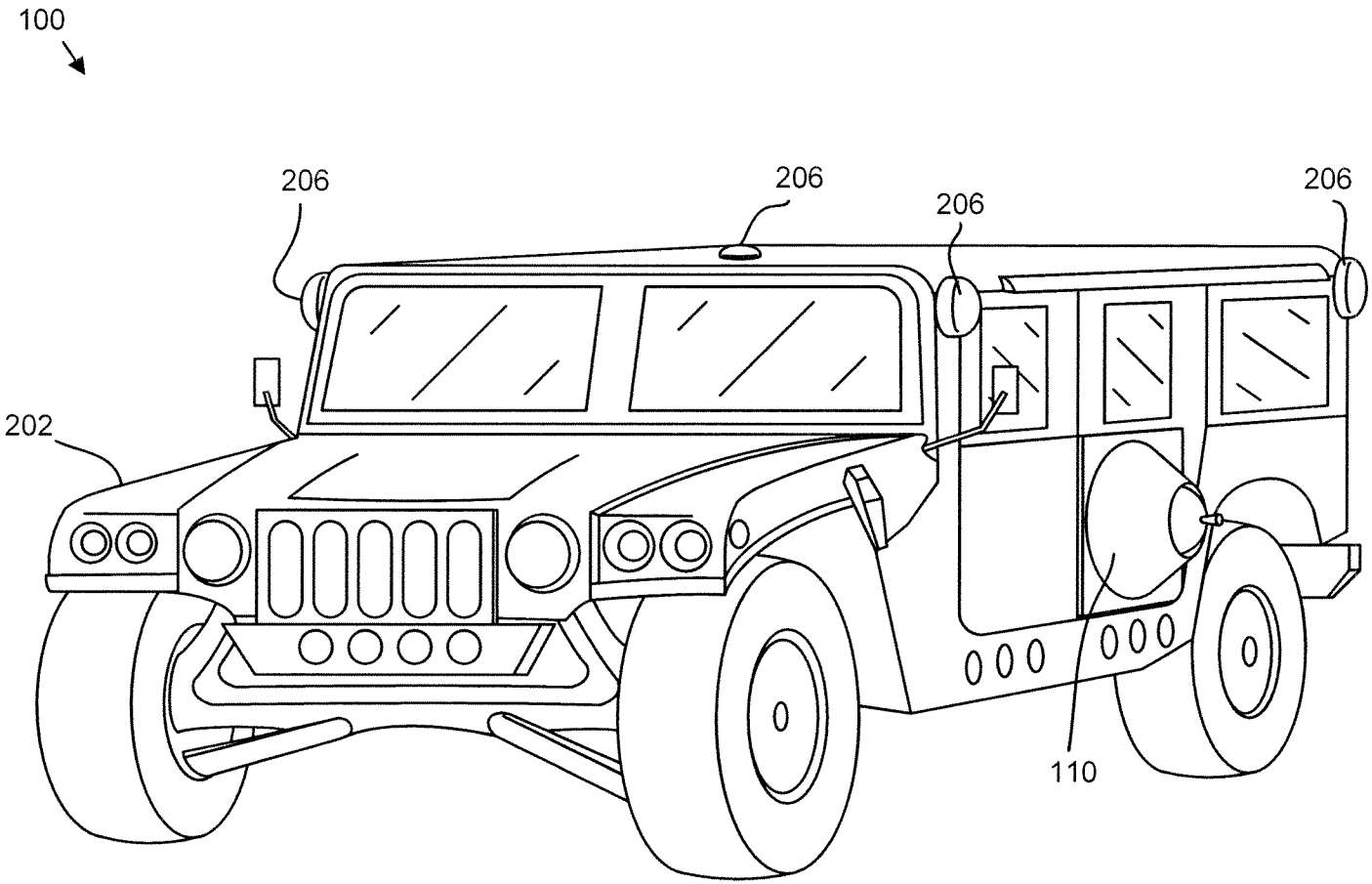
FIG. 5 is a perspective view illustrating another embodiment of a deflection system mounted on a vehicle.

FIG. 5 is a perspective view of yet another embodiment of a deflection system 100 mounted on a vehicle 202. FIG. 5 depicts a single large rocket 110 on a side of the vehicle as well as a plurality of detectors 206. Similar to the rockets of FIG. 4, the rocket 110 may be adjusted to point in different directions. In one embodiment, another similar rocket 110 are located on the front, back, top, bottom, and/or opposite side of the vehicle 202.

Returning to FIG. 1, configuration and operation of the components 102-112 of the vehicle mounted deflection systems 100 of FIGS. 1-5 will now be described.

In one embodiment, the deflection system 100 includes a detection component 102. The detection component 102 may detect one or more projectiles. This may be done by detecting one or more individual projectile objects. For example, an image or signature of a projectile object may be obtained using a camera, lidar unit, radar unit, or other detector. In one embodiment, the detection component 102 is able to detect a projectile based on object recognition in an image collected by a camera or based on a signature obtained by a lidar or radar unit.

In another embodiment, the detection component 102 detects one or more projectiles by detecting an explosion event that has generated or may generate projectiles. An explosion event may include, for example, explosion of a bomb, projectile round, or any other explosion or blast. An explosion event may generate electromagnetic radiation, which is detected by the detection component 102. For example, the explosion event may include a spike in electromagnetic radiation in the visible or infrared spectrum. In one scenario, an explosion event is preceded by an electric trigger signal of an explosive device. In this case, the detection component 102 may detect radio frequency signals.

In one embodiment, the detection component 102 determines a characteristic of one or more detected projectiles based on information obtained by a radar unit, lidar unit, camera, antenna, and/or other sensor. In one embodiment, the detection component 102 also determines characteristics of the detected projectiles based on a detected location of the projectiles and/or a detected location of an explosion event.

According to one embodiment, the detection component 102 determines an approximate size, velocity, momentum, or other characteristics of a projectile. Particle velocity may be determined based on a Doppler shift. As another example, the detection component 102 may be able to determine a projectile velocity based on movement of a projectile between captured images and/or radar or lidar scans.

According to one embodiment, the detection component 102 determines an approximate number of projectiles based, for example, on the number of signatures identified by a sensor or detector. In one embodiment, the detection component 102 determines a distribution of projectiles, i.e., how concentrated the detected projectiles are within a debris "cloud.". According to one embodiment, the detection component 102 determines a projectile type. For example, the detection component 102 may determine that detected projectiles include one or more of a debris cloud, shrapnel, a bullet, or an explosive warhead.

In one embodiment, the detection component 102 includes a prediction component 112 configured to predict a trajectory of any detected projectiles. The prediction component 112 may predict that one or more projectiles have a trajectory incident to a vehicle or other target. The prediction component 112 may predict that the one or more projectiles have a trajectory that is incident to a first location of the vehicle or target. For example, the prediction component 112 may predict that the one or more projectiles have a trajectory incident to a passenger door or other sensitive location of the vehicle.

In one embodiment, the prediction component 112 predicts a trajectory based on one or more characteristics detected by the detection component 102. For example, a projectile velocity, projectile type, distance of the projectile, and the like may affect the trajectory. The prediction component 112 may perform calculations to predict future positions of one or more projectiles and thus predict a trajectory for the projectile(s).

Figure 6:
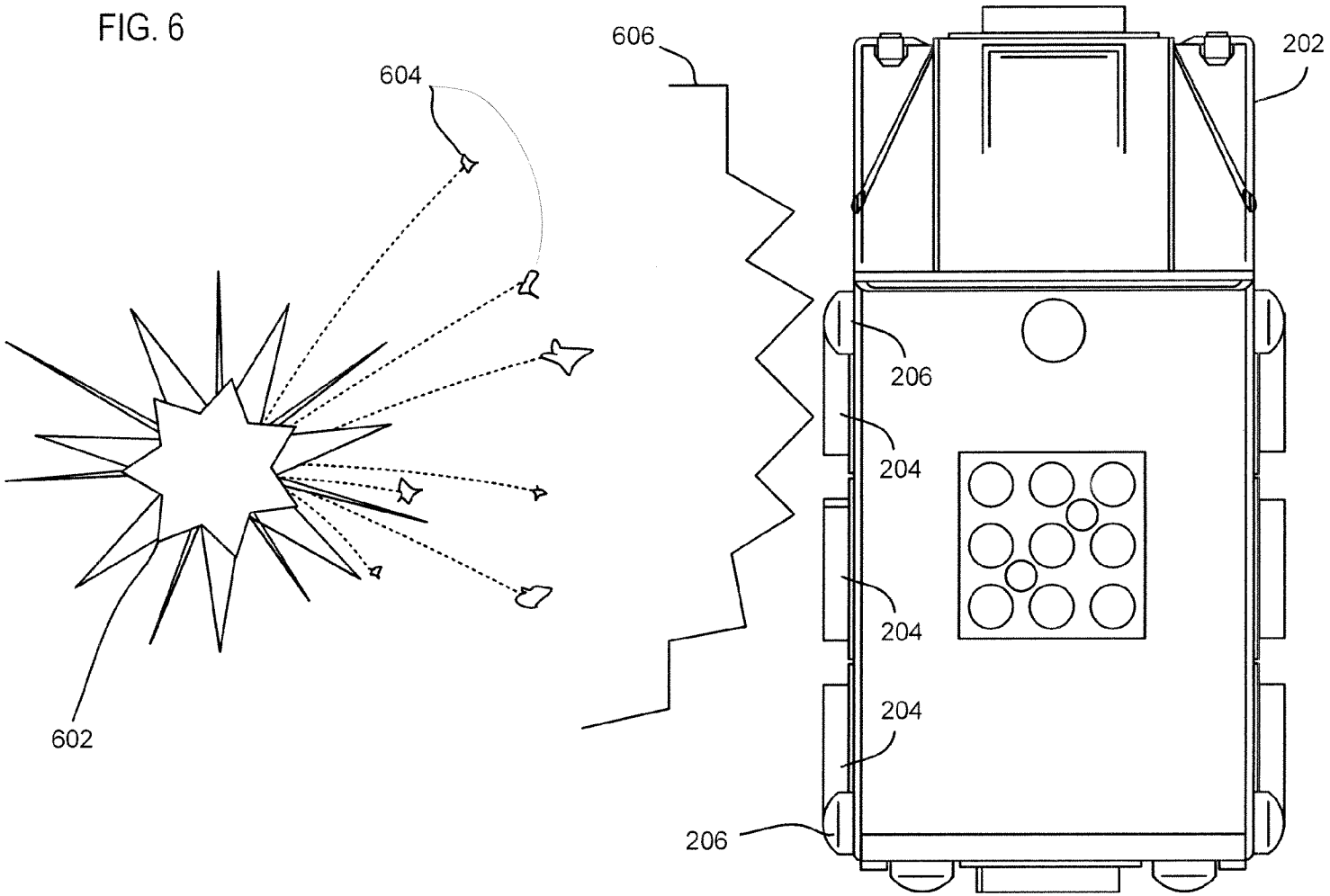
FIG. 6 is a top view illustrating an example of detection of an explosion near a vehicle.
Figure 7:
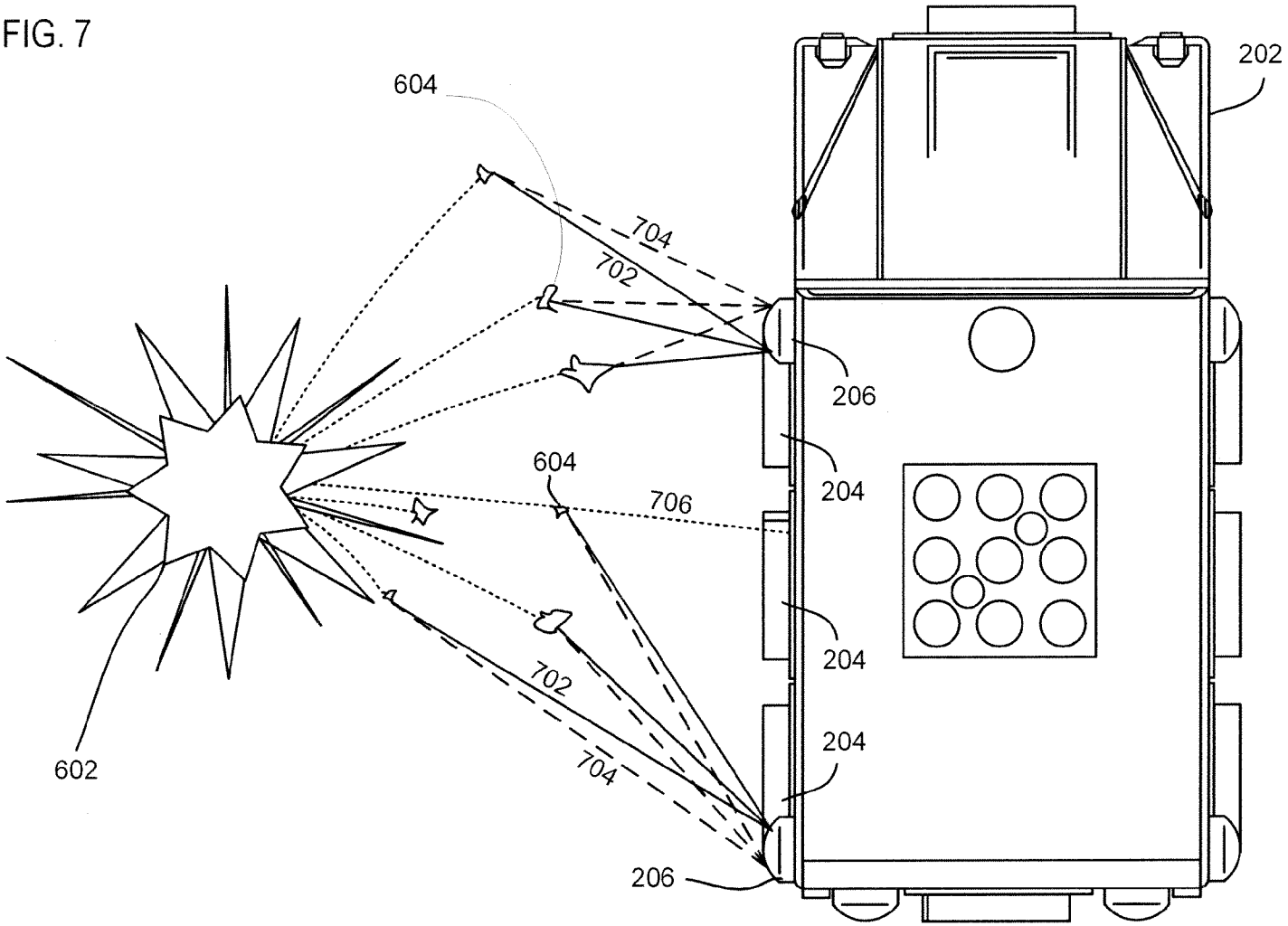
FIG. 7 is a top view illustrating another example of detection of an explosion near a vehicle.
Figure 8:
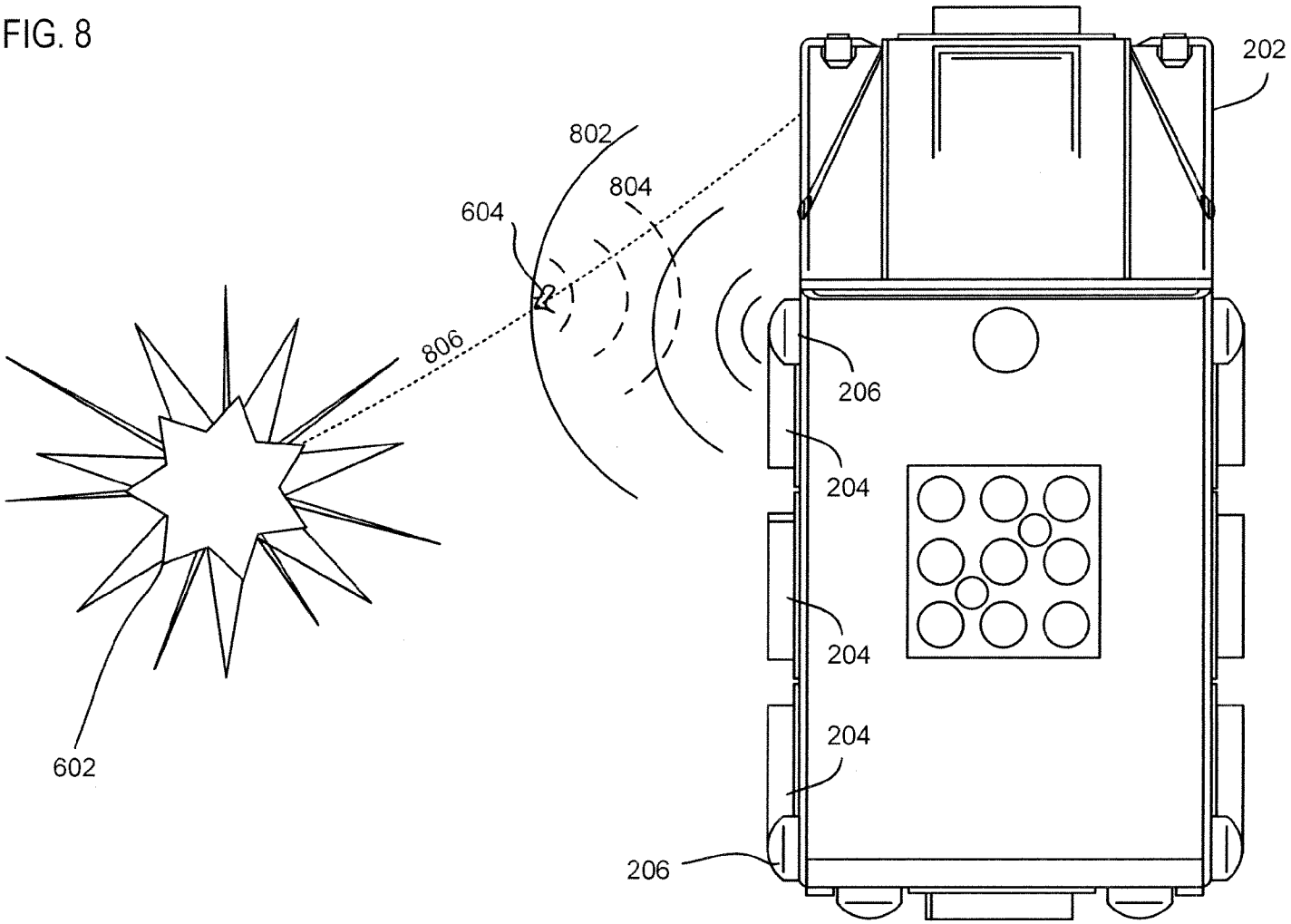
FIG. 8 is a top view illustrating yet another example of detection of an explosion near a vehicle.

FIGS. 6-8 illustrate example scenarios of detecting an explosion event 602 and/or projectiles 604. Specifically, FIG. 6 illustrates a top view of an explosion event 602 near a vehicle 202. The vehicle 202 is shown including the panels 204 and detectors 206 as depicted in FIGS. 2 and 3.

According to one embodiment, the explosion event 602 generates electromagnetic radiation 606. The electromagnetic radiation 606 may include a spike of intensity due to an explosion event or a trigger signal prior to an explosion event. In one embodiment, the detector component 102 detects the electromagnetic radiation 606 via detectors 206. Because electromagnetic radiation 606 moves more quickly than projectiles 604 from an explosion, the detectors 206 and detector component 102 may have time to detect the explosion event 602, based on the electromagnetic radiation 606, prior to impact with the projectiles 604. In one embodiment, this early detection can be used as a trigger signal to initiate operation of a lidar or radar unit in order to detect the presence and/or trajectory of the projectile. In one embodiment a lidar or radar unit is already operative and does not require initiation based on the detection of electromagnetic radiation 606.

FIG. 7 illustrates detection of an explosion event 602 using a lidar unit within the detectors 206. FIG. 7 illustrates a top view of an explosion event 602 and resulting projectiles 604. Laser beams 702 from a lidar unit in the detector 206 are illustrated encountering the projectiles 604 and reflected beams 704 are received by the detector 206. In one embodiment, the prediction component 112 of the detection component 102 predicts a trajectory 706 of one or more of the projectiles 604 based on information detected by the detection component 102. For example, the detection component 102 may determine a velocity, size, and/or location of the projectiles, and the prediction component 112 may perform a calculation to predict a path or trajectory over which the projectiles will travel.

FIG. 8 illustrates detection of an explosion event 602 using a radar unit within the detectors 206. Radio waves 802 from a radar unit in the detector 206 are illustrated encountering a projectile 604 and reflected waves 804 are received by the detector 206. In one embodiment, the prediction component 112 of the detection component 102 predicts a trajectory 806 of the projectile 604. The prediction component 112 may predict the trajectory 806 based on information detected by the detection component 102.

Returning to FIG. 1, the deflection system 100 may include a selection component 104 configured to automatically select one or more rockets to deflect the projectile(s). In one embodiment, the selection component 104 selects two or more rockets mounted on a vehicle to deflect the projectiles. In one embodiment, the selection component 104 selects the rockets based on a determination that the selected rockets, when ignited, will produce exhaust streams configured to deflect the one or more projectiles to a trajectory that is not incident to the vehicle. In one embodiment, the deflected trajectory is incident to a less sensitive location of the vehicle. In another embodiment, the deflected trajectory is not incident to the vehicle.

In one embodiment, the selection component 104 automatically selects one or more rockets based on information collected and/or provided by the detection component 102. For example, projectile characteristics such as velocity, location, projectile size, projectile type, and the like may be provided to the selection component 104 by the detection component 102. Additionally, the detection component 102 may provide a predicted trajectory or other information to the selection component 104. In one embodiment, the selection component 104 automatically selects one or more rockets based on this information.

In various embodiments, the selection component 104 automatically selects one or more rockets from a collection of rockets to deflect a projectile. For example, a collection of rockets may include rockets 110 within the panels 204 of FIGS. 2-4. In one embodiment, the selection component 104 selects a first rocket from a first group of rockets and selects a second rocket from a second group of rockets. For example, a first group of rockets may include rockets 110 on one panel 204 shown in FIGS. 2-4 and a second grouped of rockets may include rockets 110 on another panel 204 at a different location. The selection component 104 may select one rocket from one of the panels 204 and another rocket from another one of the panels 204.

According to one embodiment, the rockets 110 within a collection of rockets have a variety of different properties. In one embodiment, some rockets are larger (and hold more fuel) than others. For example, a larger rocket may be capable of a greater exhaust flow rate or a longer burn duration. In one embodiment, some rockets have different orientations than other rockets. For example, some rockets may point in a direction normal to a surface of the vehicle 202 while other rockets point in a direction that has an angle less than ninety degrees with respect to the surface. In one embodiment, some rockets are located at different locations on a target. In FIGS. 2-4, for example, some rockets 110 are located on a rear of a vehicle 202, while other rockets 110 are located on a side or top of the vehicle 202. In one embodiment, some rockets are located on an underside of the vehicle 202.

In one embodiment, different rockets are configured to have different exhaust flow rates, directions, or rates of diversion for exhaust streams. Rockets using different types of fuel may be included. For example, one rocket may include solid fuel while another rocket may use liquid fuel. Some rockets may use both liquid and solid fuel/propellants. In one embodiment, a rocket with solid fuel includes layers of fuel having different combustion rates. Numerous other variations are also possible in relation to the characteristics of rockets within a collection of rockets.

According to one embodiment, each of the rockets 110 within a deflection system 100 or collection of rockets are independently selectable. According to another embodiment, two or more rockets are only selectable as a group. In one embodiment, for example, all rockets 110 within the same rocket compartment 208 are selectable only as a group. In another embodiment, for example, rockets 110 on the same panel 204 are only selectable as a group.

In one embodiment, the selection component 104 sequentially or substantially simultaneously selects rockets to deflect projectiles. For example, the selection component 104 may select one or more rockets to deflect a first set of one or more projectiles and also select one or more additional rockets to deflect a second set of one or more projectiles. According to one embodiment, selection of different rockets to deflect different projectiles allows the deflection system 100 to deflect projectiles from a series of attacks or to deflect a large number of projectiles that may be incident to a target at approximately the same time.

According to one embodiment, the selection component 104 selects two or more rockets to deflect a single projectile or to deflect a single set of projectiles. For example, the selection component 104 selects two or more rockets such that they will both produce exhaust streams that affects the trajectory of the same projectile or the same set of projectiles. In one embodiment, the selection component 104 selects two or more rockets to produce exhaust streams configured to impact the one or more projectiles at substantially the same time. For example, the selected rockets may be located and/or oriented such that they will produce exhaust that will intercept a trajectory of a projectile at about the same point in time and/or space. In one embodiment, the selection component 104 selects at least two rockets whose exhaust streams are to be combined through an exhaust coupler. Thus, exhaust from the two rockets may be intermixed to impact the one or more projectiles at about the same time.

In another embodiment, the selection component 104 selects two or more rockets to produce exhaust streams configured to impact the one or more projectiles at different times. In one embodiment, the selection component 104 selects two or more rockets to produce exhaust streams configured to impact the one or more projectiles at different locations. For example, a first rocket may be selected to deflect a projectile earlier on in its trajectory than a second rocket. In one embodiment, exhaust from a first rocket deflects a projectile from an initial trajectory and exhaust from a second rocket further deflects the projectile. In one embodiment, a second rocket that is unable to produce exhaust to affect an initial trajectory is able to affect the trajectory as modified by a first rocket. According to one embodiment, serial deflection of a single projectile or set of projectiles by a series of rockets allows for greater deflection than could be produced with a single rocket. According to one embodiment, serial operation of two or more rockets can be performed in coordination with continued operation of the detection component 102; for instance the effect of the first rocket in deflecting the projectile trajectory can be monitored by the detection component, and a revised trajectory prediction can be used in the selection or operation of a second rocket.

In one embodiment, the selection component 104 selects one or more rockets based on a location of an explosion event. In one embodiment, the selection component 104 selects all or a subset of rockets on the left side of a vehicle when an explosion event occurs to the left of the vehicle. In FIG. 6, for example, the selection component 104 selects all of the rockets within the panels 204 on the left side of the vehicle to fire. According to one embodiment, selecting rockets based on a location of an explosion event allows for extremely fast response times to explosions. On the other hand, many rockets may be selected even if they are not needed. For example, in some cases, only a portion of the rockets within the panels 204 on the left side of the vehicle 202 may be needed to deflect the projectiles 604.

In one embodiment, the selection component 104 selects one or more rockets based on a trajectory predicted by the prediction component 112. For example, the selection component 104 may select one or more rockets that may create exhaust streams through which a projectile is predicted to pass. In FIG. 7, for example, the predicted trajectory 706 will likely pass through exhaust streams to be produced by one or more rockets in the middle panel 204 on the left side of the vehicle. According to one embodiment, the selection component 104 would select one or more rockets on the middle panel 204 to deflect the projectile 604 on trajectory 706.

In one embodiment, the selection component 104 ignores projectiles that have trajectories that are not incident to the target or a sensitive location of the target. In FIG. 8, for example, projectile 604 has a trajectory 806 incident to a front end of the vehicle, which has been heavily armored. According to one embodiment, the detection component 102 and/or selection component 104 may determine that the projectile should be ignored and the selection component 104 does not select any rockets to deflect the projectile 604 on trajectory 806.

In one embodiment, the selection component 104 predicts, based on information received from the detection component 102, a time at which a projectile will pass through an exhaust stream to be produced by one or more rockets. The selection component 104 may select a rocket 110 to be ignited at the predicted time. In one embodiment, the selection component 104 takes into account a delay in igniting a rocket before an exhaust stream reaches full strength. In one embodiment, the selection component 104 takes into account a delay in transit time for the exhaust stream to travel to the site at which it impacts with the projectile. The selection component 104 may determine a required degree of deflection needed to produce a new trajectory that is not incident to the vehicle or is at least not incident to a sensitive area of the vehicle. The selection component 104 may then select one or more rockets that are predicted to be sufficient to deflect the one or more projectiles by the required degree of deflection.

According to one embodiment, the selection component 104 selects a rocket based on characteristics of the projectiles, the explosion event, and/or the rockets. The detection component 102 provides characteristics regarding a size of a projectile to the selection component 104. The selection component 104 may select a rocket having an exhaust stream with a higher momentum flux or exhaust flow rate when the projectile size is larger. As used herein, the terms momentum flux and flow rate are given to mean the rate at which a given amount of exhaust or given mass of exhaust is flowing in an exhaust stream. In one embodiment, the selection component 104 selects a rocket having a lower divergence when the projectile size is larger. Likewise, in some embodiments, the selection component 104 selects a larger number of rockets when the projectile size is larger.

The detection component 102 may provide characteristics regarding a number of projectiles to the selection component 104. The selection component 104 may select a rocket having an exhaust stream with a higher momentum flux or exhaust flow rate when the number of projectiles is larger. In one embodiment, the selection component 104 selects a rocket having an exhaust stream with a higher divergence when the number of projectiles is larger. In one embodiment, the selection component 104 selects a larger number of rockets when the number of projectiles is larger.

According to one embodiment, the detection component 102 provides characteristics regarding a distribution of projectiles to the selection component 104. The selection component 104 may select a rocket having a higher momentum flux or exhaust flow rate when the distribution of projectiles is greater. The selection component 104 may select a rocket having an exhaust stream with a higher divergence when the projectiles have a wider distribution. Similarly, the selection component 104 may select a larger number of rockets when the projectiles have a wider distribution.

According to one embodiment, the selection component 104 selects a rocket based on the orientation or direction of the rocket. The selection component 104 may select a first rocket to create a first exhaust stream in a first direction and a second rocket to create a second exhaust stream in a second direction. According to one embodiment, rockets oriented in different directions allow for each rocket to provide momentum along different vectors and thus alter a trajectory more effectively. A direction of a second exhaust stream may be at least partially orthogonal to a direction of a first exhaust stream. In one scenario, a projectile at a different point in the trajectory may be more effectively deflected with different directions of exhaust streams. For example, if a trajectory of a projectile has already been altered by a first exhaust stream, a second exhaust stream with an orientation to provide more side momentum may allow for greater deflection than if both rockets had the same direction. In other words, a direction of momentum of the second exhaust stream may be at least partially orthogonal to a direction of momentum of the first exhaust stream. Additionally, as a projectile comes closer to a target, it may be possible to impart more side momentum. Thus, the angle of the exhaust stream with relation to a direction normal to the surface of the target may be increased as the projectile gets closer to the target.

According to one embodiment, the selection component 104 selects a rocket based on the flow rate and/or momentum flux of the rocket. The selection component 104 may select a first rocket to produce an exhaust stream with a particular momentum flux or flow rate and a second rocket to produce an exhaust stream with a different momentum flux or flow rate. In one embodiment, a direction of momentum of the second exhaust stream is at least partially orthogonal to a direction of momentum of the first exhaust stream. The selection component 104 may select two or more rockets 110 based on a momentum flux or flow rate of the exhaust stream of each rocket. In one embodiment, the selection component 104 selects a rocket based on a specific impulse of the rockets. The specific impulse may be an approximation for a momentum flux or flow rate of a rocket.

In one embodiment, the selection component 104 selects a rocket based on a divergence of exhaust for each rocket. For example, an exhaust stream of a first rocket may diverge at a different rate than an exhaust stream of a second rocket. Lower divergences may allow for a larger amount of force to be provided per unit area. Higher divergences may allow for a larger number of projectiles or objects to be simultaneously affected by an exhaust stream.

In one embodiment, the selection component 104 determines the timing for igniting the selected rockets. The selection component 104 may determine, for example, that all of the selected rockets should be ignited at the same time. In another case, the selection component 104 may determine that one rocket should be ignited earlier than another rocket. For example, if a projectile will not pass through the exhaust stream of a first rocket until after it passes through the exhaust stream of a second rocket, it may be desirable to delay the ignition of the first rocket after ignition of the second rocket. As another example, the effect of rocket exhaust may increase as a projectile gets closer to the rockets so it may be desirable to increase the amount of exhaust produced by igniting more rockets as the projectile gets closer. As another example, the amount of deflection impulse which must be delivered to the projectile to induce a desired change in its impact site with the vehicle may increase the closer it is to the impact site, thereby making it desirable for the exhaust stream to reach the projectile at an earlier time. According to one embodiment, timing for ignition of rockets is based, for example, on one or more of a burn length of a rocket (the length of time over which the rocket is capable of producing exhaust), a location of a rocket, an orientation of a rocket, a trajectory of a projectile, a time at which the projectile will pass through the exhaust streams of a rocket, and the like.

Returning to FIG. 1, the deflection system 100 may include an ignition component 106. In one embodiment, the ignition component 106 ignites the selected rockets. In one embodiment, the ignition component 106 ignites the rockets based on information or instructions (e.g., timing instructions) provided by the selection component 104 or the adjustment component 108.

The rockets may include various types of fuel, including solid and/or liquid fuel/propellant. In one embodiment, the fuel type is selected to provide quick ignition times. For example, the amount of time between the detection of a projectile and impact with the vehicle may be extremely small. Thus, rockets that are capable of fast ignition times and generation of powerful exhaust streams may be desirable. For example, solid fuels or propellants may include ingredients such as powdered aluminum, polybutadiene-acrylontrile-acrylic acid (PBAN), an ammonium perchlorate composite propellant (APCP), an amonium nitrate-based propellant (ANCP), ammonium dinitramide (ADN), or the like. Liquid fuels or propellants may include ingredients such as liquid oxygen (LOX), kerosene, liquid hydrogen, nitrogen tetroxide (N2O4), hydrazine (N2H4), monomethylhydrazine (MMH), unsymmetrical dimethylhydrasine (UDMH), or the like. One of skill in the art will understand that the above fuels/propellants are given by way of example only and that numerous other fuels or propellants may be used. The ignition component 106 may ignite a rocket by providing an electrical signal, which may initiate the flow of a liquid fuel/propellant and/or induce a spark or provide heat to ignite the fuel.

In one embodiment, the ignition component 106 also ignites additional rockets besides those used to deflect a projectile. For example, the ignition component 106 may ignite one or more additional rockets to oppose any thrust produced by rockets that are deflecting a projectile. For example, one or more selected rockets, when ignited, may produce a first thrust vector relative to the vehicle, which may cause the vehicle 202 to veer and or crash. In one embodiment, the ignition component 106 ignites one or more additional rockets to produce a second thrust vector opposing the first thrust vector. For example, rockets on a substantially opposite side of the vehicle 202 may be ignited to minimize the effects of the thrust provided by the selected rockets.

Figure 9A:
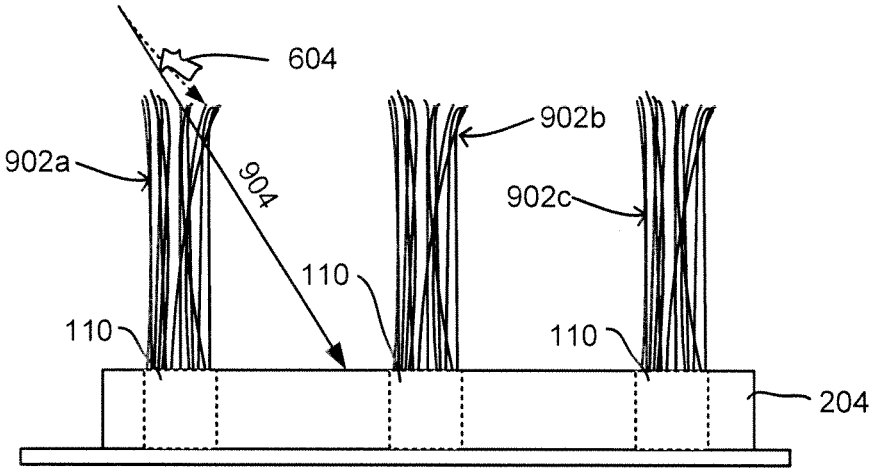
FIG. 9A-9C are side views illustrating an example of deflection of a projectile using rocket exhaust.
Figure 9B:
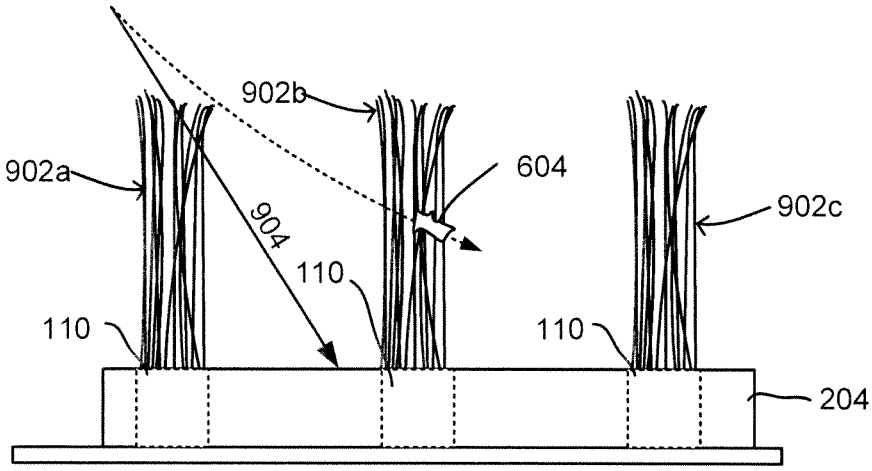
Figure 9C:
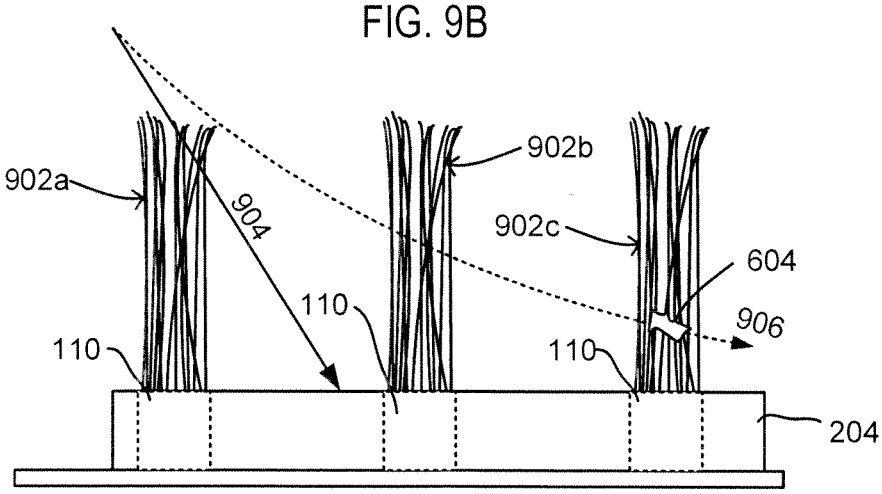

FIGS. 9A-9C illustrate the deflection of a projectile by one or more exhaust streams. FIGS. 9A-9C are side views of a panel 204 and embedded rockets 110 creating exhaust streams 902*a*-902*c* to deflect a projectile 604 from an incident trajectory 904. In one embodiment, the rockets 110 have a fixed orientation and all point in a direction normal to a surface of the panel 204. In other embodiments, the rockets 110 are adjustable to point in a different direction or may have fixed directions that are at an angle.

In the illustrated embodiment, the detection component 102 has detected the projectile 604 and the prediction component 112 has predicted that the trajectory 904 is incident to the vehicle. In one embodiment, the selection component 104 has selected the rockets 110 in the panel 204 for ignition and the ignition component 106 has ignited the rockets 110 to produce exhaust streams 902*a*-902*c*.

In FIG. 9A, the projectile 604 is shown encountering the exhaust stream 902*a*, such that the projectile is deflected from the incident trajectory 904. In FIG. 9B, the projectile 604 is shown encountering the exhaust stream 902*b*, which provides further deflection. Finally, in FIG. 9C, the projectile 604 is shown encountering the exhaust stream 902*c* which provides sufficient deflection to prevent the projectile 604 from impacting the panel 204 and the vehicle 202.

In the depicted embodiment, the rockets 110 are shown pointing in the same direction and are all ignited at the same time during the duration of deflection of the projectile 604. In other embodiments, the rockets 110 are ignited at different times and/or have different orientations. For example, the rockets 110 may be ignited such that exhaust stream 902*a* is ignited earlier in time than the exhaust streams 902*b* and 902*c*.

Returning to FIG. 1, the deflection system 100 may further include an adjustment component 108 that adjusts one or more of the exhaust streams to more effectively deflect the projectile(s). The adjustment component 108 may adjust a variety of properties of an exhaust stream. For example, the adjustment component 108 may adjust a direction, flow rate, momentum flux, or divergence of the exhaust stream. As used herein, "adjustment" of an exhaust stream should be understood to mean adjustment between non-zero values. In other words, adjustment does not include turning an exhaust stream on or off.

In one embodiment, the adjustment component 108 adjusts the exhaust streams prior to, during, or after ignition of the rocket(s). For example, due to the short periods of time that often exist between detection and impact, the rocket(s) may need to be ignited before the direction, divergence, and/or flow rate is adjusted. On the other hand, where sufficient time exists, pre-adjustments or concurrent adjustments may be made. In one embodiment, pre-adjustments may be made speculatively, in anticipation of a projectile being launched from a given location, e.g., a structure at the side of the road.

In one embodiment, the adjustment component 108 adjusts the exhaust streams by changing a direction (aiming) the exhaust stream(s) of one or more rockets. For example, the adjustment component 108 may aim an exhaust stream to maximize the impact of the stream on the trajectory of a projectile. The change of direction may occur incrementally over time. For example, the adjustment component 108 may incrementally change an aimed direction such that the exhaust stream follows a position of a projectile.

According to one embodiment, the adjustment component 108 includes a pivot mechanism upon which one or more rockets are mounted. The adjustment component 108 may aim the exhaust stream(s) by pivoting the one or more rockets on the pivot mechanism.

Figure 10A:
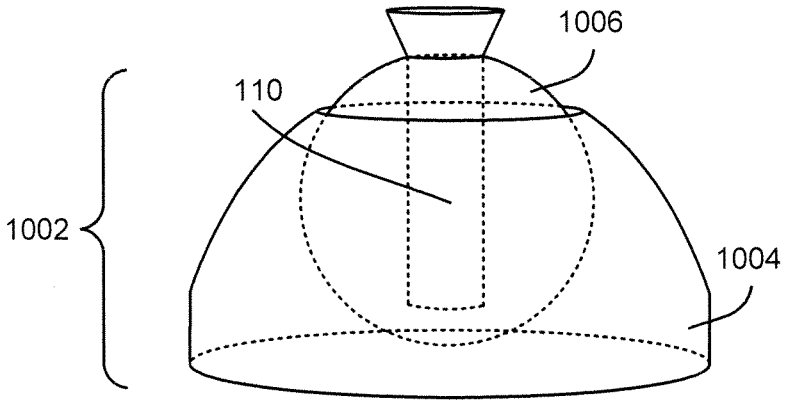
FIGS. 10A-10C illustrate one embodiment of a pivot mechanism for adjusting a direction of an exhaust stream.
Figure 10B:
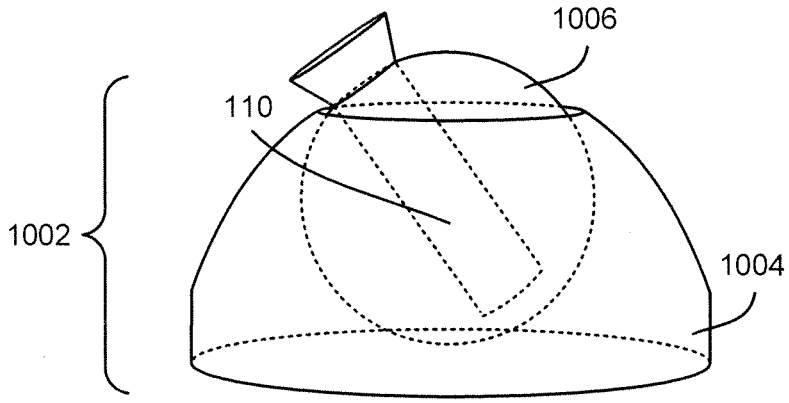
Figure 10C:
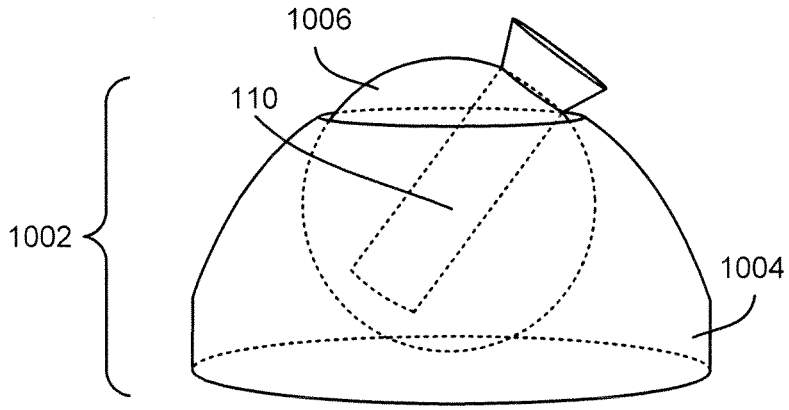

FIGS. 10A-10C and 11A-11C illustrate embodiments of pivot mechanisms. Specifically, FIGS. 10A-10C illustrate a pivot mechanism that includes a ball and socket joint 1002 including a socket 1004 and ball 1006. The ball 1006 is seated within the socket 1004 and is allowed to rotate with respect to the socket 1104 without being released from within the socket 1104. The ball 1006 may include an embedded rocket 110. In one embodiment, as the ball 1006 rotates with respect to the socket 1004, the direction of the rocket 110 and the corresponding exhaust stream will be changed, as shown in FIGS. 10A-10C. According to one embodiment, the rockets 110 of FIGS. 4 and 5 are mounted to a pivot mechanism similar to the ball and socket joint 1002 of FIGS. 10A-10C.

Figure 11C:
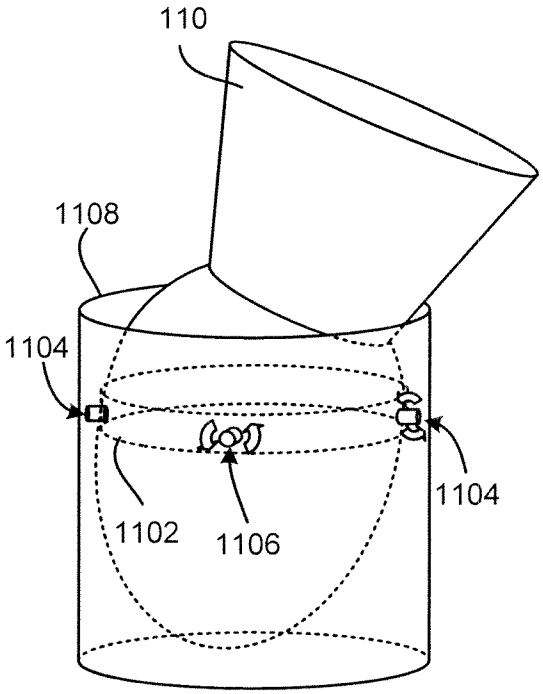
FIGS. 11A-11C illustrate another embodiment of a pivot mechanism for adjusting a direction of an exhaust stream.
Figure 11B:
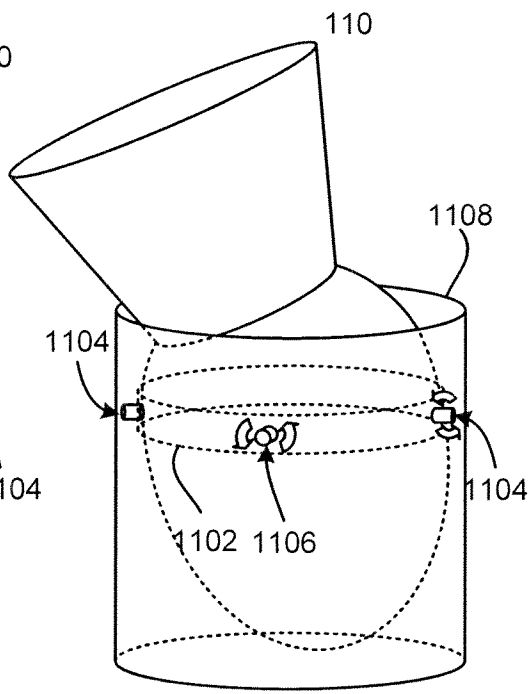
Figure 11A:
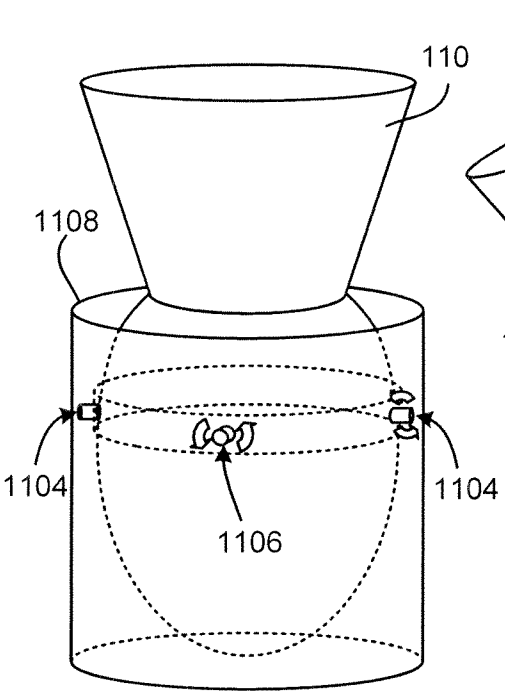

The pivot mechanism of FIGS. 11A-11C includes a ring 1102 and pivots 1104, 1106 to form a gimballed rocket 110. The ring 1102 is mounted to an interior of a cylinder 1108 via pivots 1104. The ring 1102 may be pivoted in relation to the cylinder 1108 about the pivots 1104. The ring 1102 is mounted to the rocket 110 via pivots 1106. The rocket 110 may be pivoted in relation to the ring about the pivots 1104. Thus, the rocket 110 is mounted on gimbals, which allows the rocket to pivot and move with two degrees of freedom, similar to the ball and socket joint 1002 of FIGS. 10A-10C, and thus aim the rocket 110 and any resulting exhaust stream, as illustrated in FIGS. 11A-11C. According to one embodiment, the rocket(s) within rocket compartments 208 of FIGS. 2 and 3 are mounted to a vehicle using a pivot mechanism similar to the gimbals of FIGS. 11A-11C. In one embodiment, an adjustment component 108 includes an actuator to actuate the position of the rockets 110 of FIGS. 10A-10C and 11A-11C. For example, a rod, motor, and/or other actuator may be used to adjust a position of the rockets 110.

In one embodiment, an adjustment component 108 aims exhaust streams of one or more rockets to point in a direction at least partially orthogonal to a trajectory of a projectile. In some cases, it is more effective to impart momentum orthogonally to a direction of the projectile's trajectory rather than to directly oppose the trajectory. For example, it may not be possible for a rocket of a given size to impart enough momentum to a projectile to stop a fast moving projectile. However, the same rocket may be capable of producing enough side momentum for the rocket to be diverted enough to avoid impact with the vehicle. In one embodiment, the adjustment component 108 may determine a required degree of deflection to produce a new trajectory that is not incident to a sensitive location on the vehicle. For example, the adjustment component 108 may determine a required degree of deflection to deflect a projectile from a first trajectory incident to a vehicle to a second trajectory not incident to the vehicle. The adjustment component aims one or more rockets to deflect the one or more projectiles by the required degree of deflection.

Figure 12A:
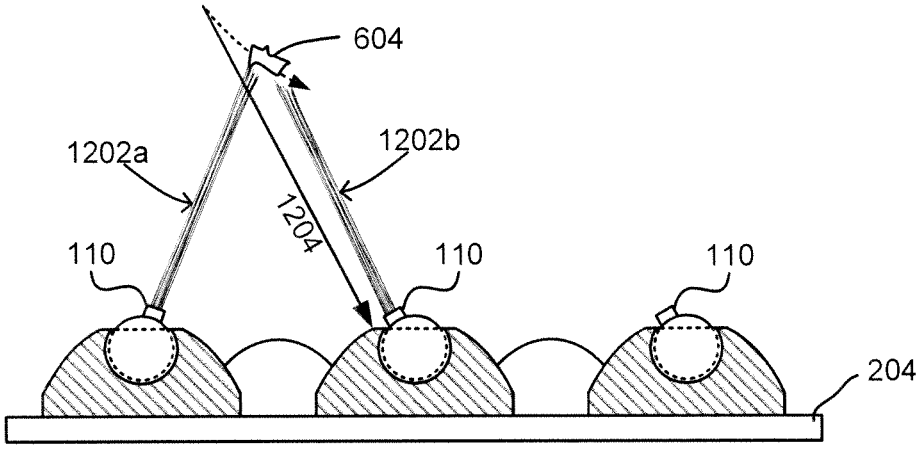
FIG. 12A-12C are side views illustrating an example of deflection of a projectile using rocket exhaust.
Figure 12B:
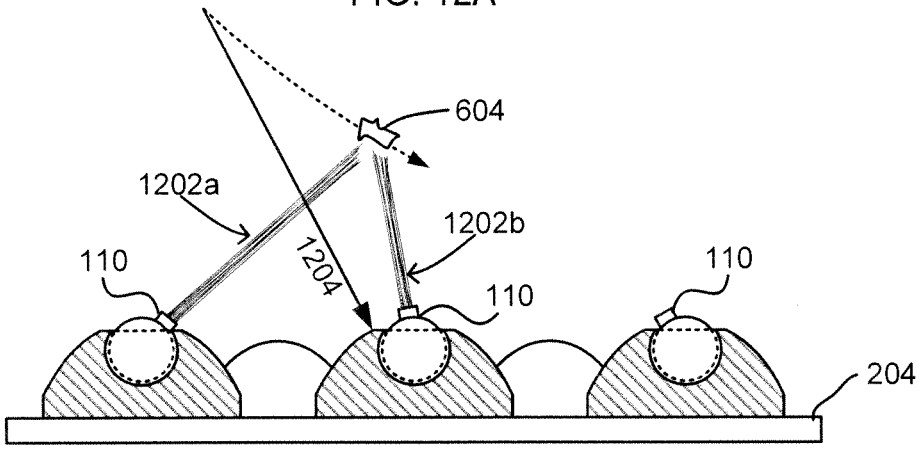
Figure 12C:
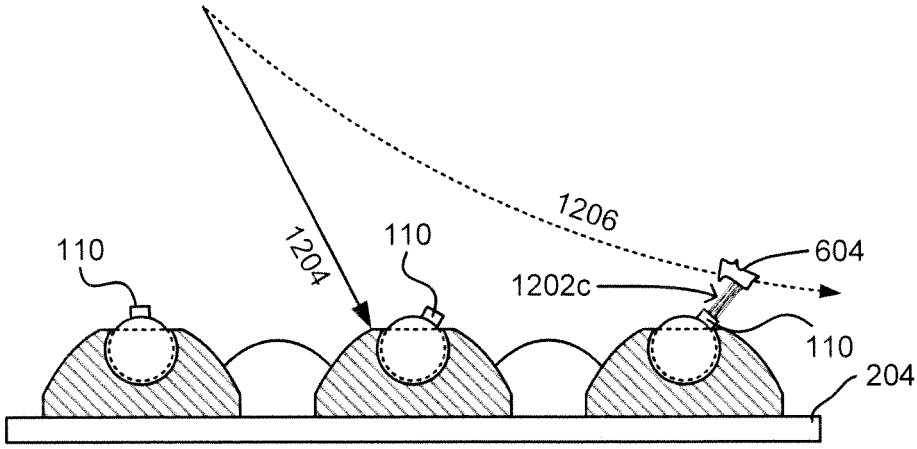

FIGS. 12A-12C illustrates aiming and actuation of rockets mounted on a pivot mechanisms. Specifically, FIGS. 12A-12C is a cross-sectional side view of a panel 204 of FIG. 4 illustrating rockets 110 during deflection of a projectile and illustrates aiming of direction of exhaust streams as well as variations of timing in ignition of rockets 110. The panel 204 includes rockets 110 which are mounted via ball and socket joints as depicted in FIGS. 10A-10C. In FIG. 12A a projectile 604 with trajectory 1204 encounters exhaust streams 1202*a* and 1202*b*. In FIG. 12B the projectile 604 has moved to a new position. In one embodiment, as the projectile 604 has moved, the rockets 110 have pivoted such that the exhaust streams 1202*a* and 1202*b* have followed and continue to deflect projectile 604. In FIG. 12C the projectile 604 has moved to a new position. In this case, the rockets producing exhaust streams 1202*a* and 1202*b* have burned out or have been suppressed and a rocket 110 has been ignited to create exhaust stream 1202*c*. The projectile 604 is shown deflected from the original trajectory 1204 to a new trajectory 1206.

According to one embodiment, an adjustment component 108 aims one or more exhaust streams by combining exhaust from a first rocket with exhaust from a second rocket to divert an exhaust stream produced by the first rocket. For example, one rocket may be oriented at an angle with respect to another rocket and exhaust from the rockets may be combined to adjust a direction of an exhaust stream. In various embodiments, the two rockets are of a similar size or may be of different sizes. In one embodiment, a first rocket includes a nozzle and a second and smaller rocket is mounted near the nozzle of the first rocket. The smaller rocket may be ignited to deflect the exhaust stream of the larger rocket and thereby aim the exhaust stream of the larger rocket. In such a case, the smaller rocket may have a lower exhaust flow rate than the first rocket.

In one embodiment, a plurality of smaller rockets mounted near a nozzle of a larger rocket are able to aim the exhaust stream of the larger rocket in a variety of directions. For example, the adjustment component 108 may aim an exhaust stream by combining exhaust from a large rocket with exhaust from second and third smaller rockets. In one embodiment, with two or more smaller rockets, the exhaust stream of the larger rocket are aimed with two degrees of freedom. More than two smaller rockets may increase the amount of deflection in which an exhaust stream may be aimed.

Figure 13A:
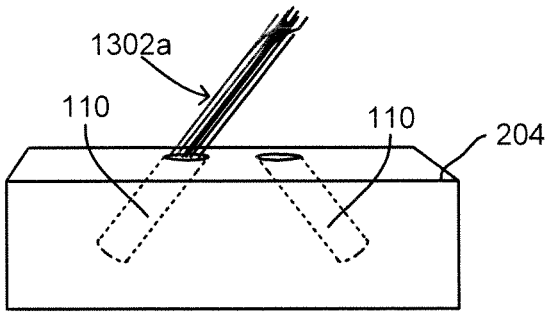
FIGS. 13A-13C are side views illustrating an example of aiming of exhaust streams using fixed rockets.
Figure 13B:
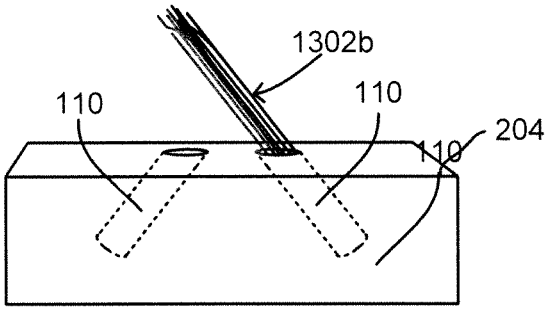
Figure 13C:
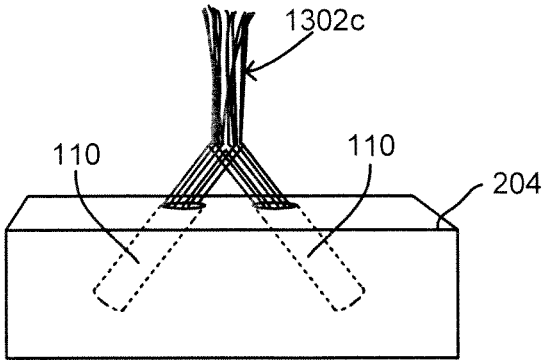

FIGS. 13A-13C illustrate aiming of an exhaust stream using two or more rockets. FIGS. 13A-13C show a portion of a panel 204 that includes first and second rockets 110. The rockets 110 are mounted at angles with respect to each other and are positioned and oriented such that exhaust streams produced by the two rockets will intersect.

In FIG. 13A a first rocket is ignited and produces a first exhaust stream 1302*a* while the other rocket is not ignited. The first exhaust stream 1302*a* is directed at an angle to the right. In FIG. 13B a second rocket 110 is ignited and produces a second exhaust stream 1302*b* while the first rocket is not ignited. The second exhaust stream 1302*b* is directed at an angle to the left. In FIG. 13C both the first rocket and second rocket 110 are ignited to produce exhaust streams. The exhaust streams 1302*a*, 1302*b* combine to form a combined exhaust stream 1302*c*. The combined exhaust stream 1302*c* points in a direction normal to the surface of the panel 204.

According to one embodiment, the rockets 110 of FIGS. 13A-13C are used to aim exhaust streams in a desired direction. For example, if a projectile needs to be deflected to the right, the first rocket may be ignited and the second rocket may be left off to produce the first exhaust stream 1302*a* at an angle to the right. Similarly, if a projectile needs to be deflected to the left, the second rocket may be ignited and the first rocket may be left off to produce the second exhaust stream 1302*b* at an angle to the left. If a projectile needs to be deflected in a direction normal to a surface of the panel 204 both rockets 110 may be ignited to produce a combined exhaust stream 1302*c*.

FIGS. 13A-13C depict one embodiment of aiming an exhaust stream by combining the exhaust stream with another exhaust stream. Other embodiments include more than two rockets. For example, exhaust from four rockets may be used in a similar manner to enable aiming in additional dimensions. In one embodiment, a single large rocket is deflected using one or more smaller rockets that are mounted at angles to the large rocket.

According to one embodiment, the adjustment component 108 includes a variable exhaust nozzle or variable-area exhaust nozzle. As used herein, the term variable exhaust nozzle is given to mean a nozzle that is adjustable to control a direction, a velocity, and/or a flow rate of exhaust. Examples of variable exhaust nozzles include an iris nozzle, an ejector nozzle, or the like. In one embodiment, the adjustment component 108 aims the one or more exhaust streams by adjusting an angle of thrust of the variable exhaust nozzle. For example, the adjustment component 108 may aim a direction of an exhaust stream by tilting or pivoting a nozzle with respect to a combustion or fuel chamber. In one embodiment, the adjustment component 108 includes an actuator for pivoting the nozzle with respect to the body of the rocket.

Figure 14:
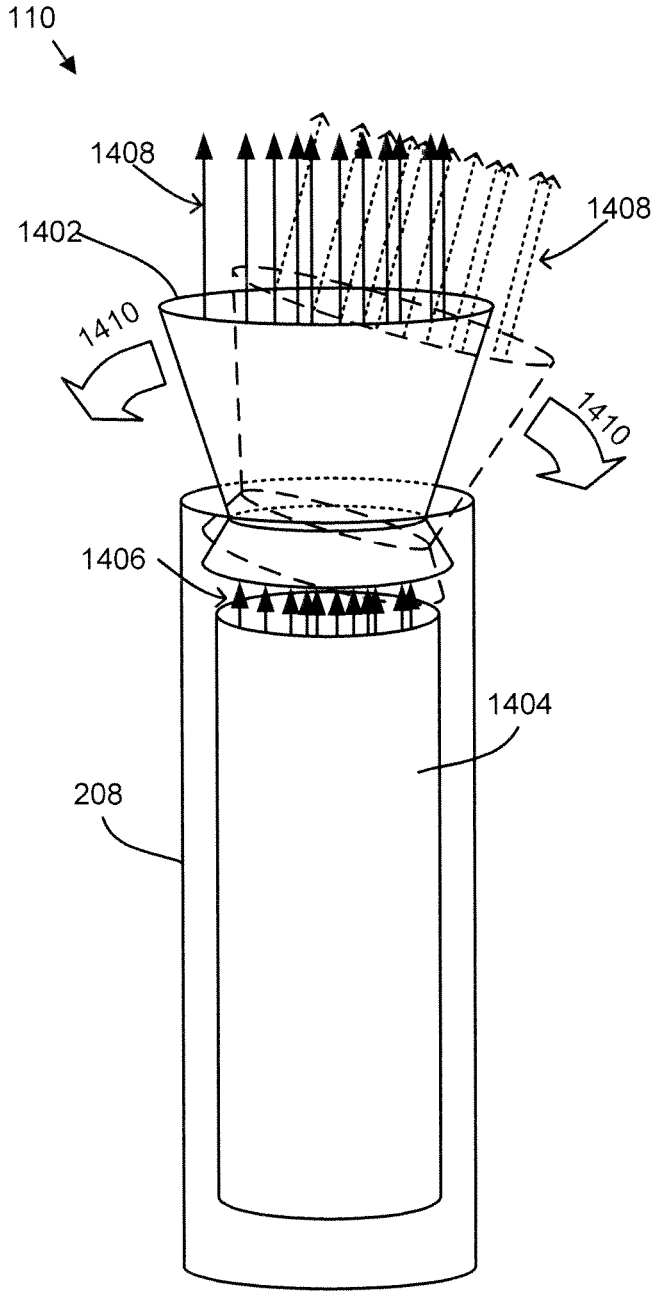
FIG. 14 illustrates one embodiment of a rocket with a variable exhaust nozzle.

FIG. 14 illustrates one embodiment of a rocket 110 with a variable exhaust nozzle 1402 that may be used to aim a direction of an exhaust stream. FIG. 14 shows a rocket 110 partially within a rocket compartment 208. In one embodiment, the rocket compartment 208 is a compartment within a panel 204. The rocket 110 includes a nozzle 1402 and a combustion chamber 1404. As is understood in the art, exhaust 1406 is propelled from the combustion chamber 1404 and through the nozzle 1402. Exhaust escapes through the nozzle 1402 to form an exhaust stream 1408. The gap between the nozzle 1402 and combustion chamber 1404 is for illustration purposes only and may not exist in all embodiments.

In one embodiment, the nozzle 1402 is pivotable in relation to the combustion chamber 1404 as indicated by arrows 1410. As the nozzle 1402 is pivoted the exhaust stream 1408 is aimed in a new direction. The nozzle 1402 may be pivoted in any direction to point the exhaust stream 1408.

According to one embodiment, the adjustment component 108 includes an exhaust deflector. In one embodiment, the adjustment component 108 aims an exhaust stream by changing a position, e.g., a location or an angle, of the exhaust deflector. For example, the exhaust deflector may comprise material that may be placed within a path of an exhaust stream to deflect the exhaust stream in a new direction. According to one embodiment, the adjustment component 108 selectively moves the exhaust deflector into or out of the exhaust stream to adjust a direction of an exhaust stream. According to one embodiment, the adjustment component 108 selectively changes the angle of the deflector relative to the exhaust stream. The exhaust deflector may include an exhaust coupler that couples exhaust from two or more rockets into a single exhaust stream. A position of an exhaust coupler may be changed to alter the direction of the single exhaust stream.

Figure 15:
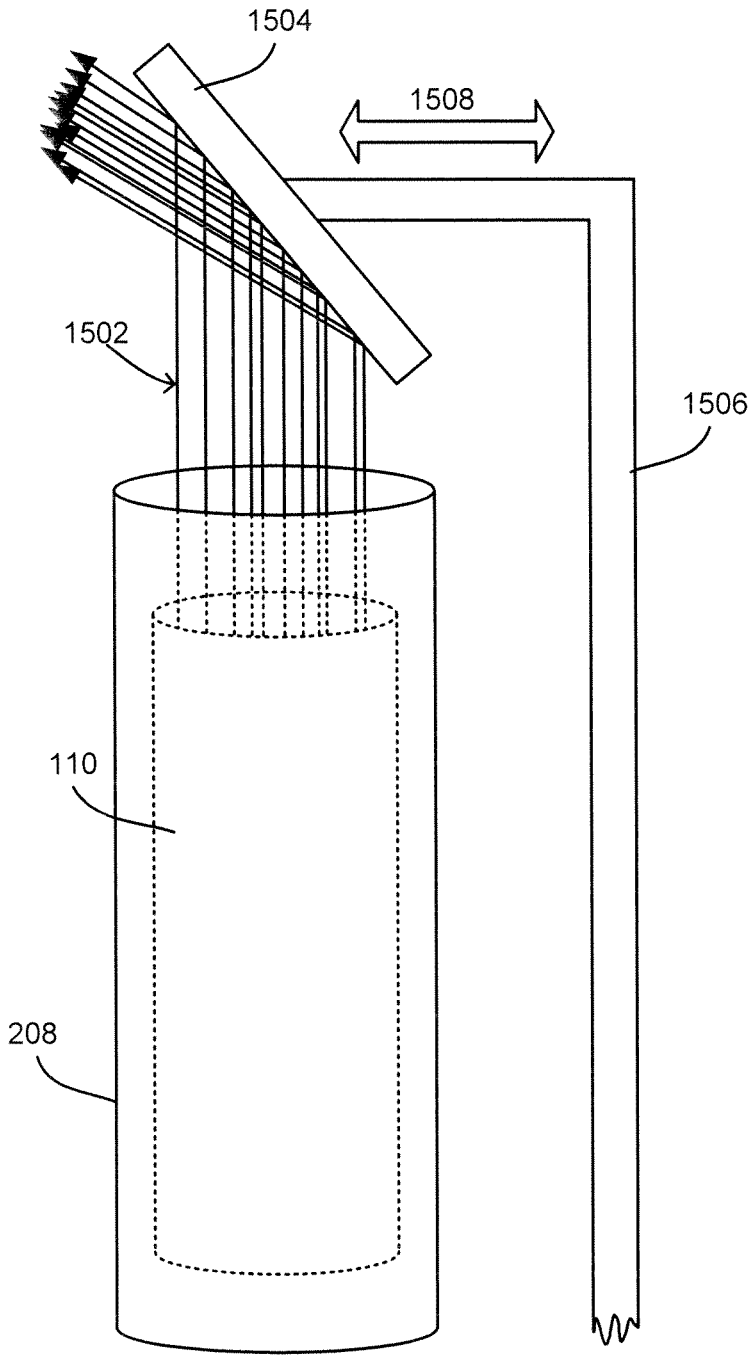
FIG. 15 illustrates an example of aiming of an exhaust stream with an exhaust deflector.

FIG. 15 illustrates one embodiment of an exhaust stream 1502 aimed using an exhaust deflector 1504. A rocket 110 is shown within a rocket compartment 208. The rocket compartment 208 may be a compartment within a panel 204. The rocket produces an exhaust stream 1502 that is deflected by an exhaust deflector 1504. According to one embodiment, the exhaust deflector 1504 includes a heat resistant material that deflects the flow of the exhaust stream 1502, such that the direction of the exhaust stream is adjusted or aimed. For example, the exhaust stream 1502 is shown deflected to the left by the exhaust deflector 1504. The exhaust deflector 1504 is mounted on an arm 1506, which may be actuated to move the exhaust deflector 1504 into or out of the exhaust stream 1502. Arrow 1508 illustrates that a position of the exhaust deflector 1504 may be adjusted, such that the direction of the exhaust stream 1502 may be changed. In one embodiment, the arm 506 may be rotated around the rocket 110 such that the exhaust deflector 1504 can deflect the exhaust stream 1502 in various directions. In one embodiment, the tilt of the exhaust deflector 1504 may be varied, changing the amount and direction by which it deflects the exhaust stream.

Figure 16:
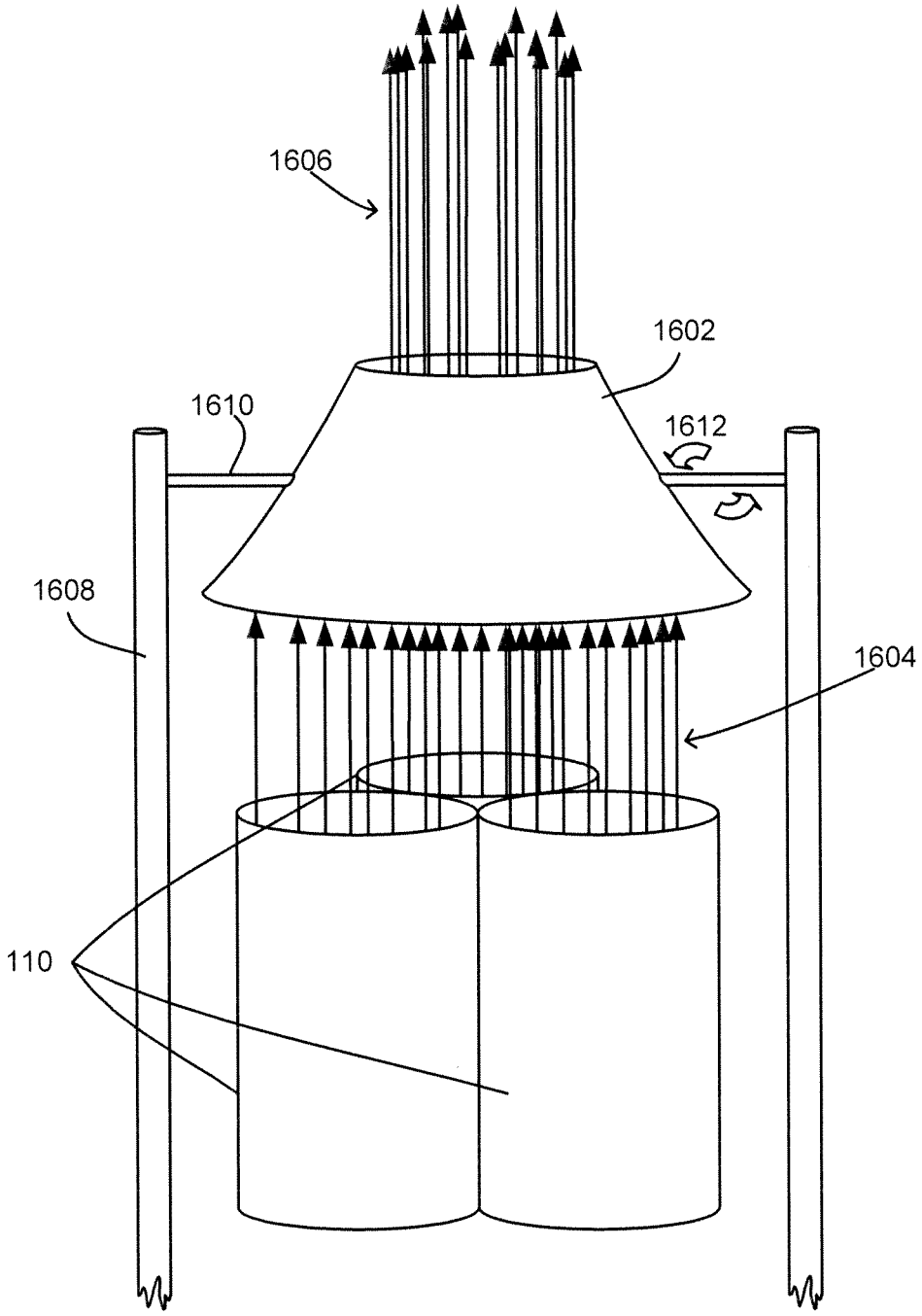
FIG. 16 illustrates one embodiment of an exhaust coupler.

FIG. 16 illustrates one embodiment of an exhaust coupler 1602 for coupling exhaust 1604 from multiple rockets 110 into a combined exhaust stream 1606. The exhaust coupler 1604 is depicted having a conical shape that funnels exhaust 1604 from multiple rockets 110 into a combined exhaust stream 1606. In one embodiment, each of the rockets 110 includes a nozzle or other directing mechanism to focus or aim exhaust 1604. In one embodiment, each of the rockets 110 includes a combustion chamber without a nozzle and the exhaust coupler 1602 couples exhaust 1604 from the combustion chambers into a single exhaust stream 1606.

The exhaust coupler 1602 may be mounted on arms 1608 and pivots 1610. In one embodiment, the arms 1608 and pivots 1610 are actuated by the adjustment component 108 to control a direction of the combined exhaust stream 1606. For example, the exhaust coupler 1602 may be pivoted about pivots 1610, as indicated by arrows 1612, to point the exhaust stream 1606 in a desired direction. Similarly, the arms 1608 may be moved up or down together or independently to change a direction of the exhaust stream 1606.

Numerous variations of the embodiment of FIG. 16 are possible. For example, the exhaust coupler 1602 may be mounted on top of the rockets 110 with little or no gap. In one embodiment, the exhaust coupler 1602 may include a nozzle. For example, a nozzle may be mounted at the small end of the exhaust coupler 1602. In one embodiment, a nozzle on the exhaust coupler is a variable exhaust nozzle similar to that of FIG. 14.

The adjustment component 108 may control a flow rate of one or more exhaust streams by adjusting a burn rate of a rocket. For example, for a solid fuel rocket, the adjustment component 108 may control an amount of solid fuel that is ignited. The adjustment component 108 may control a flow of propellant (e.g., oxidizer) that is used to combust with the solid fuel. In one embodiment, a rocket includes one or more combustion chambers and the adjustment component 108 may control whether fuel in each of the combustions chambers will be ignited. In one embodiment, the adjustment component 108 controls the flow rate by controlling a number of rockets whose exhaust is combined to produce an exhaust stream. For example, the adjustment component 108 may include an exhaust coupler 1602 and the adjustment component 108 may determine a timing and/or whether or not each rocket 110 should be ignited. For example, the adjustment component 108 may control which of the rockets 110 of FIG. 16 are ignited. As another example, for a liquid propellant rocket, the adjustment component 108 may control a flow rate of the liquid propellant. In one embodiment, the liquid propellant includes a liquid fuel and/or a liquid oxidizer.

The adjustment component 108 may determine a required flow rate to deflect the one or more projectiles from the first trajectory to the second trajectory. For example, the adjustment component 108 may receive information from the detection component 102 regarding a velocity, number, size, direction, trajectory or other characteristic of incoming projectiles and determine a flow rate or momentum flux that will be needed to deflect the projectiles. The adjustment component 108 may determine a flow rate or momentum flux needed to deflect the detected projectiles from impacting a target and/or impacting a sensitive area of a target. In one embodiment, the adjustment component 108, controls the flow rate or momentum flux of the one or more exhaust streams to substantially match the determined flow rate. In one embodiment, the detection component 102 determines a deflection impulse required to deflect the projectile to the second trajectory. The adjustment component 108 may control the exhaust streams to have a higher flow rate when the deflection impulse is greater.

In one embodiment, the adjustment component 108 controls a flow rate of the one or more exhaust streams based on the characteristics determined by a detection component 102. For example, the detection component 102 may determine a projectile size, and the adjustment component 108 controls the exhaust streams to have a higher flow rate when the projectile size is larger. In one embodiment, the detection component 102 determines a number of projectiles and the adjustment component 108 controls the exhaust streams to have a higher flow rate when the number of projectiles is larger. In one embodiment, the detection component 102 determines a distribution of projectiles and the adjustment component 108 controls the exhaust streams to have a higher flow rate when the projectiles have a wider distribution. In one embodiment, the detection component 102 determines a projectile velocity and the adjustment component 108 controls the exhaust streams to have a higher flow rate when the projectile velocity is greater.

According to one embodiment, the adjustment component 108 adjusts an exhaust stream by controlling a divergence of the exhaust stream. For example, the adjustment component 108 may control how quickly the exhaust stream diverges, or spreads out.

Figure 17A:
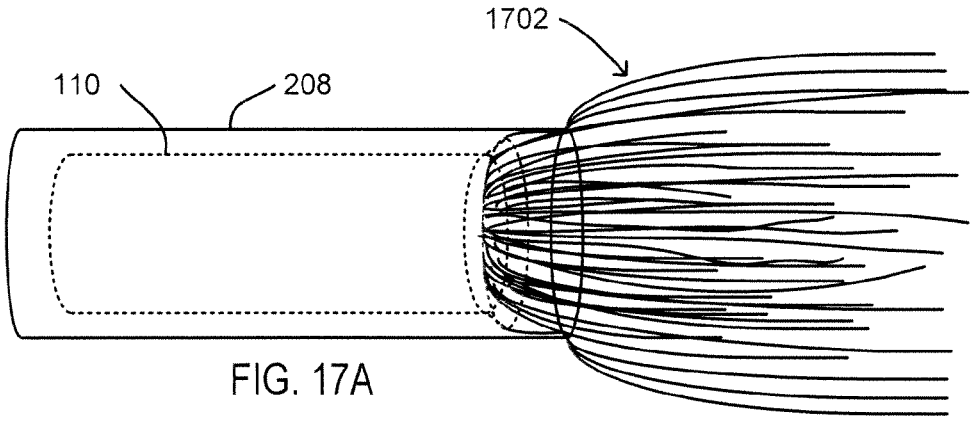
FIGS. 17A-17C illustrate exhaust streams diverging at different rates, according to one embodiment.
Figure 17B:
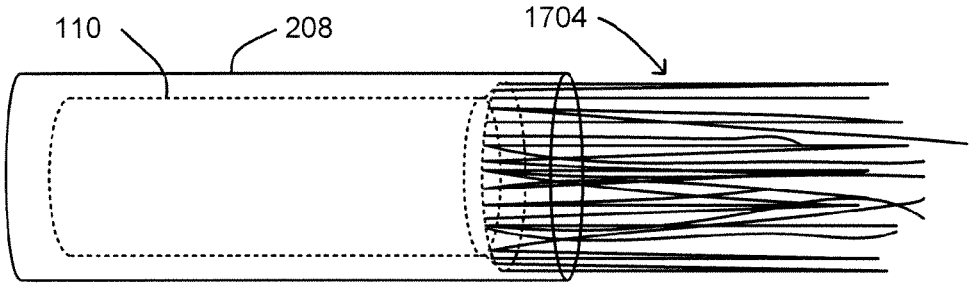
Figure 17C:
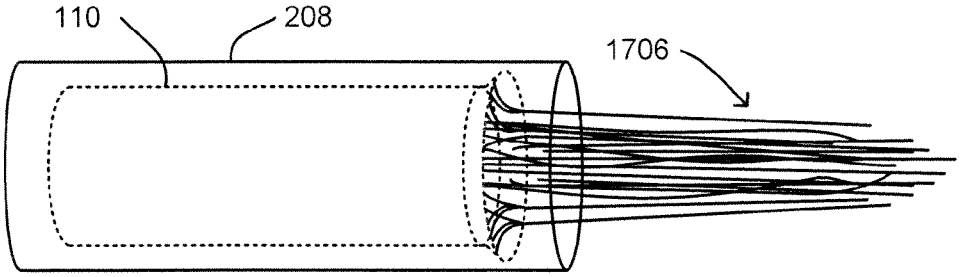

FIGS. 17A-17C illustrate variations in divergence of rocket exhaust. FIGS. 17A-17C illustrate a rocket 110 within a rocket compartment 208 that are generating exhaust streams 1702-1706. FIG. 17A illustrates an exhaust stream 1702 that has a high divergence. FIG. 17B illustrates an exhaust stream 1704 with a lower divergence, and FIG. 17C illustrates an exhaust stream 1706 that has very low divergence, and may be described as convergent. The exhaust stream 1702 spreads out quickly. In one scenario, the high divergence is desirable to deflect a large number of small and/or spread out projectiles. However, the higher divergence exhaust stream may not provide as much force or deflection momentum as a less divergent exhaust stream on projectiles that are further way. For example, exhaust streams 1704 and 1706 may be able to provide more force on a projectile when it is further away from the rocket 110. In one embodiment, the least divergent (or convergent) exhaust stream 1706 is able to provide more force on a single projectile. On the other hand, it may be more difficult to accurately aim the exhaust stream 1706 to affect a projectile or it may not be sufficient to deflect a plurality of projectiles.

The adjustment component 108 may control a divergence of an exhaust stream in a variety of ways. In one embodiment, the adjustment component 108 controls a divergence of an exhaust stream using a variable exhaust nozzle. For example, the variable exhaust nozzle may be adjustable to change an opening size of the nozzle. In one embodiment, a variable exhaust nozzle includes an "ejector" nozzle or "iris" nozzle. According to one embodiment, the shape and size of the opening of the nozzle affects how quickly the exhaust of an exhaust stream diverges. A variable exhaust nozzle may be located on a single rocket or may be located on an exhaust coupler 1602 for multiple rockets. For example, the variable exhaust nozzle 1402 of FIG. 14 may be located on the exhaust coupler 1602 of FIG. 16.

In another embodiment, the adjustment component 108 controls the divergence of the one or more exhaust streams by combining exhaust from a first rocket with exhaust from a second rocket to control the divergence of an exhaust stream produced by the first rocket. For example, exhaust from multiple rockets 110 may be combined to form a more divergent exhaust stream similar to that depicted in FIGS. 13A-13C.

Figure 18B:
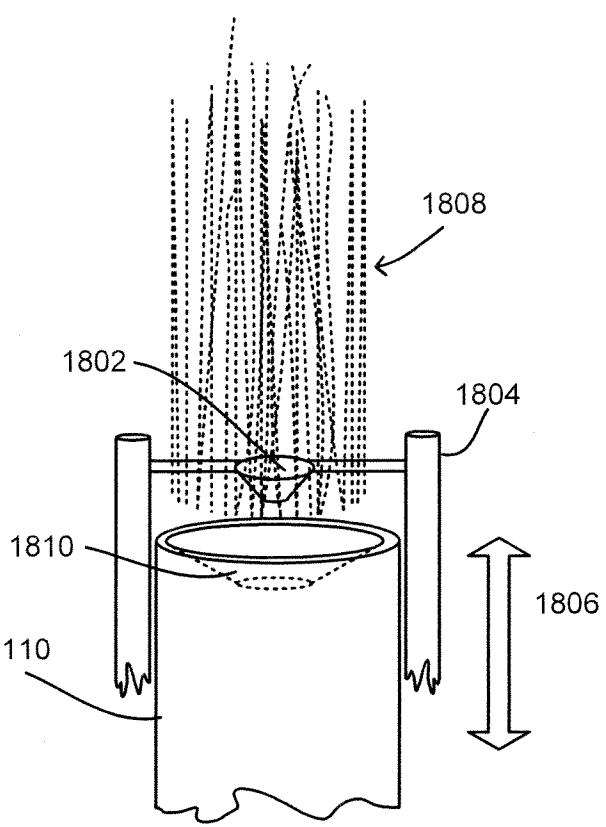
FIGS. 18A-18B illustrate one embodiment of an exhaust insert for controlling a divergence of an exhaust stream.
Figure 18A:
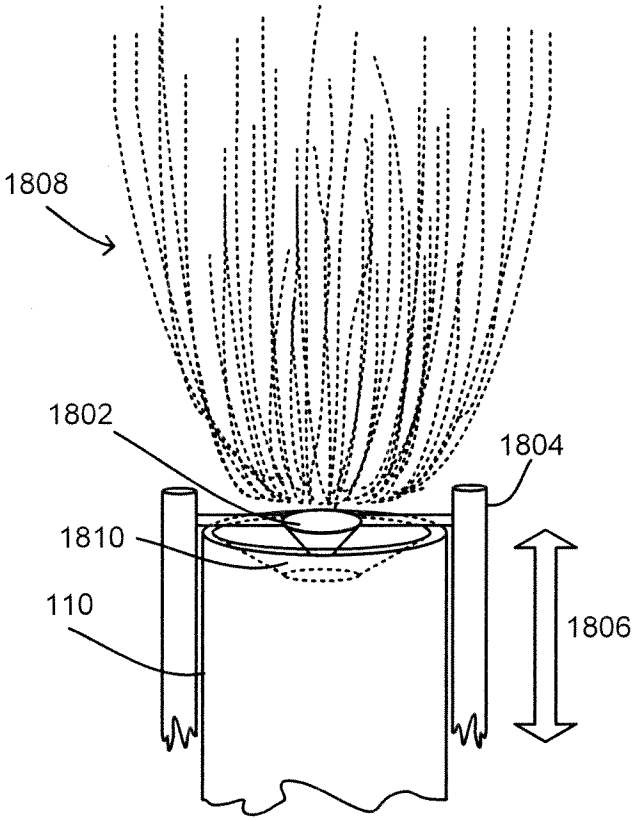

In one embodiment, the adjustment component 108 includes a nozzle insert. The adjustment component 108 may control a position of the nozzle insert to control a divergence of an exhaust stream. FIGS. 18A-18B illustrate one embodiment of a nozzle insert 1802. The nozzle insert 1802 of FIGS. 18A-18B is shown mounted on arms 1804 to be held within the exhaust streams 1808. The arms 1804 may be actuated to move up and down as indicated by arrow 1806. FIG. 18A shows the insert 1802 closer to the nozzle 1810 of the rocket 110, which results in a higher divergence for the exhaust stream 1808. FIG. 18B shows the insert 1802 further away from the nozzle of the rocket 110, which may result in a lower divergence for the exhaust stream 1808.

According to one embodiment, the adjustment component 108 determines a required divergence for an exhaust stream to deflect a projectile. The adjustment component 108 may control the divergence of the exhaust stream to match the required divergence. In one embodiment, the adjustment component 180 controls the divergence of an exhaust stream based on characteristics determined by the detection component 102. For example, the detection component 102 may determine a deflection impulse required to deflect a projectile, and the adjustment component 108 may control the exhaust stream to have a lower divergence when the deflection impulse is greater. In one embodiment, the detection component 102 determines a projectile size and the adjustment component 108 controls the exhaust streams to have a lower divergence when the projectile size is larger. In one embodiment, the detection component 102 determines a number of projectiles, and the adjustment component 108 controls the exhaust streams to have a higher divergence when the number of projectiles is larger. In one embodiment, the detection component 102 determines a distribution of projectiles and the adjustment component 108 controls the exhaust streams to have a higher divergence when the projectiles have a wider distribution. In one embodiment, the detection component 102 determines a projectile velocity and the adjustment component 108 controls the exhaust streams to have a lower divergence when the projectile velocity is greater.

Figures 19A, 19B, 19C:
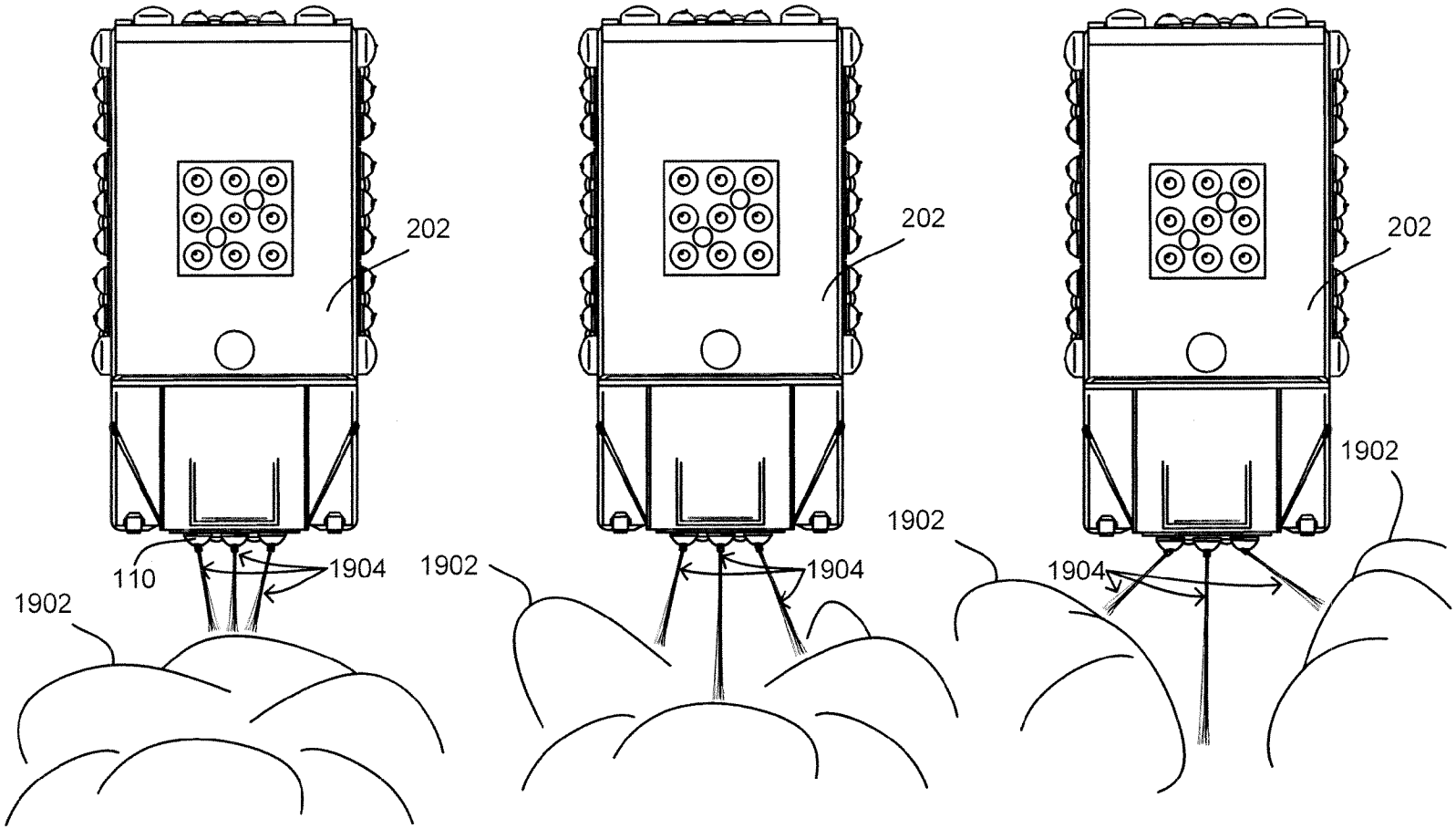
FIGS. 19A-19C are top views illustrating an example of deflection of a debris cloud.

FIGS. 19A-19C, 20A-20C, 21A-21C, and 22A-22C illustrate embodiments of deflection of projectiles. FIGS. 19A-19C are top views illustrating deflection of a debris cloud 1902 originating from an explosion in front of a vehicle 202. According to one embodiment, detectors on a front panel 204 of the vehicle 202 or other detectors have detected the explosion and/or the debris cloud 1902. The vehicle 202 is illustrated with a deflection system 100 with steerable rockets 110 similar to that depicted in FIG. 4. The debris cloud 1902 may include particles and projectiles resulting from an explosion of an explosive device, such as an IED, grenade, artillery round, or the like. In one embodiment, the debris cloud 1902 includes shrapnel and/or other fast moving projectiles that may damage the vehicle and/or harm its occupants. According to one embodiment, at least some projectiles within the debris cloud 1902, if not deflected, would impact the vehicle.

FIG. 19A illustrates rockets 110 on the front of the vehicle that have been ignited to produce exhaust streams 1904. The exhaust streams 1904 are aimed at the center of the debris cloud 1902. According to one embodiment, the rockets 110 are adjusted to produce exhaust streams 1904 to begin deflecting at least some projectiles of the debris cloud 1902 from an original trajectory FIG. 19B illustrates the exhaust streams 1904 and debris cloud 1902 in positions subsequent to those shown in FIG. 19A. In FIG. 19B the rockets 110 on the front of the vehicle 202 are continuing to produce exhaust streams 1904. However, the exhaust streams 1904 have been adjusted to aim in a new direction. One of the exhaust streams 1904 continues to point straight ahead of the vehicle while the other exhaust streams 1904 point at angles forward and toward the side of the vehicle 202. The debris cloud 1902 is shown splitting into two different clouds. In other words, some projectiles of the debris clouds 1902 are being deflected to the right of the vehicle 202 while other projectiles are being deflected to the left of the vehicle 202. Some projectiles may be actually slowed to a stop or deflected upwards or downwards with respect to the vehicle.

FIG. 19C illustrates the exhaust streams 1904 and debris cloud 1902 in positions subsequent to those shown in FIG. 19B. Once again, the rockets 110 are continuing to produce exhaust streams 1904, but some of the exhaust streams have been adjusted to point in new directions. One of the exhaust streams 1904 continues to point straight ahead of the vehicle 202, while the other exhaust streams 1904 point at even greater angles to the side of the vehicle 202. The greater angle of the exhaust streams 1904 may impart increased side momentum to projectiles within the debris cloud 1902. The debris cloud 1902 has been split into two different clouds and the projectiles of the debris clouds are passing harmlessly to the sides of the vehicle 202.

According to one embodiment, the changing directions of the exhaust streams 1904 are calculated in real time or are selected from available pre-programmed positions. For example, the detection component 102 may detect a location of an explosion and the adjustment component 108 may select a direction profile for that location from a table or database. Selection from a table may improve response time and allow the deflection system 100 to more effectively and quickly respond to an explosion or other projectile threat. According to one embodiment, the changing directions of the exhaust streams 1904 are calculated in real time based on updates in the detected or predicted trajectory of the projectile (e.g., due to ongoing operation of radar or lidar sensors).

Figures 20A, 20B, 20C:
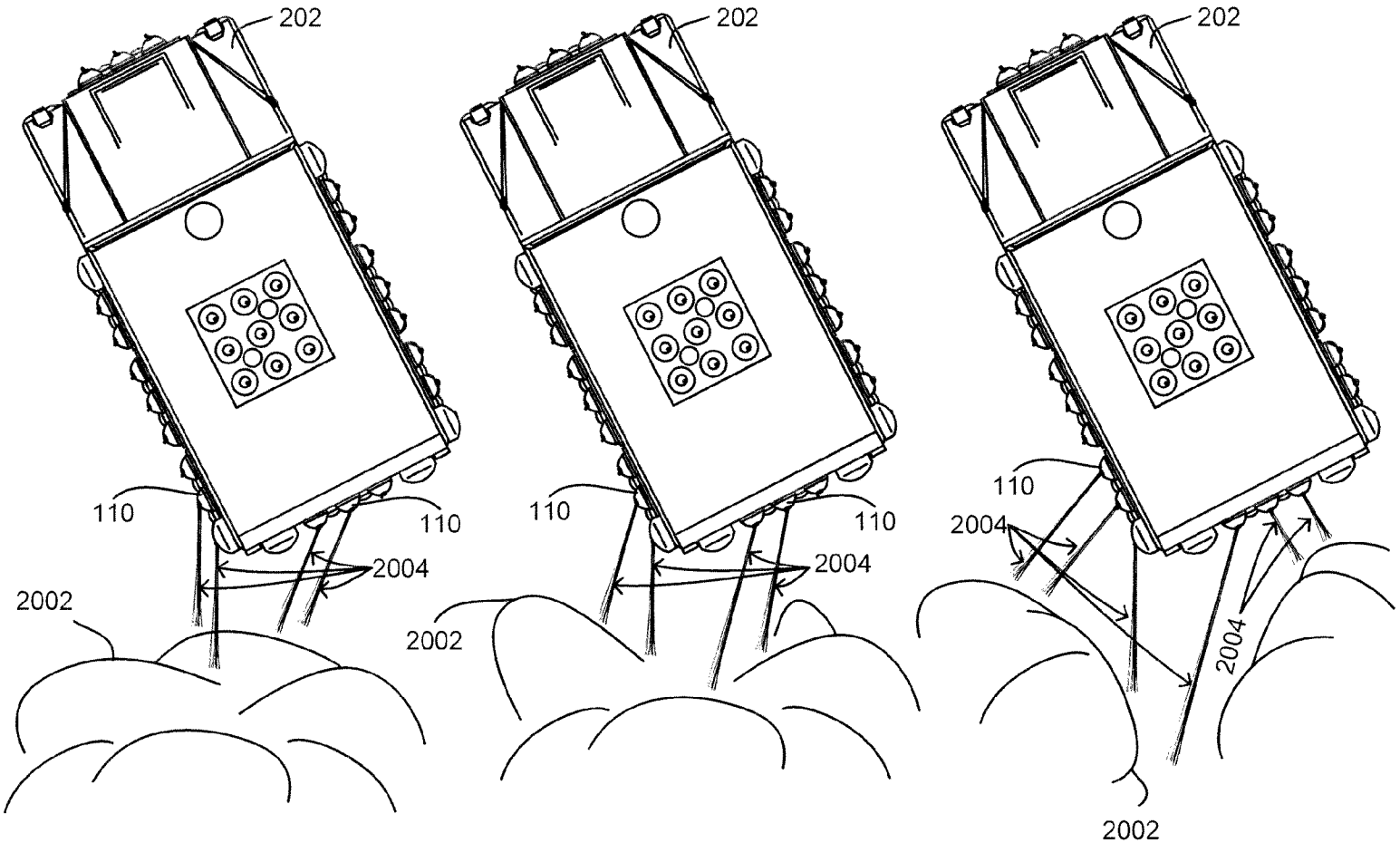
FIGS. 20A-20C are top views illustrating an example of deflection of a debris cloud.

FIGS. 20A-20C are top views illustrating deflection of a debris cloud 1902 originating from an explosion to the left and rear of a vehicle 202. According to one embodiment, detectors on the vehicle detect the explosion or resulting debris cloud 2002, and rockets 110 are ignited to produce exhaust streams 2004. FIG. 20A shows exhaust streams 2004 pointed towards the debris cloud 2002. FIG. 20B depicts the exhaust streams 2004 in a subsequent position to continue deflection of the debris cloud 2002, or particles within the debris cloud 2002. According to one embodiment, exhaust streams 2004 are adjusted to aim in a direction to provide more side momentum relative to an original trajectory of the debris cloud 2002 and/or the vehicle 202. The debris cloud 2002 is shown beginning to split into two clouds that are being deflected along the sides of the vehicle.

FIG. 20C depicts the debris cloud 2002 and exhaust streams 2004 in positions subsequent to those in FIG. 20B. Additional rockets 110 have been ignited to provide additional exhaust streams 2004 to further deflect the debris cloud 2002 as portions of the debris cloud 2002 move into the range of the additional rockets. The debris cloud 2002 is depicted as being split into two different debris clouds with a majority of the projectiles of the debris cloud passing to the sides of the vehicle 202.

Figure 21A:
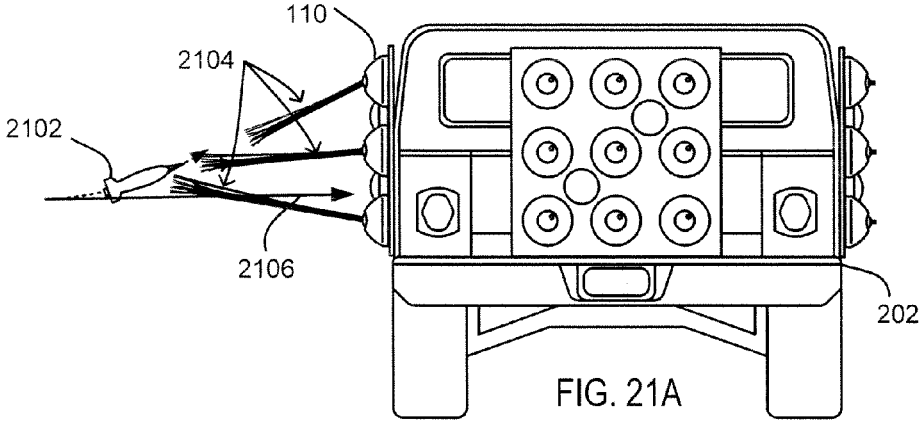
FIGS. 21A-21C are rear views illustrating an example of deflection of a projectile having an explosive warhead.
Figure 21B:
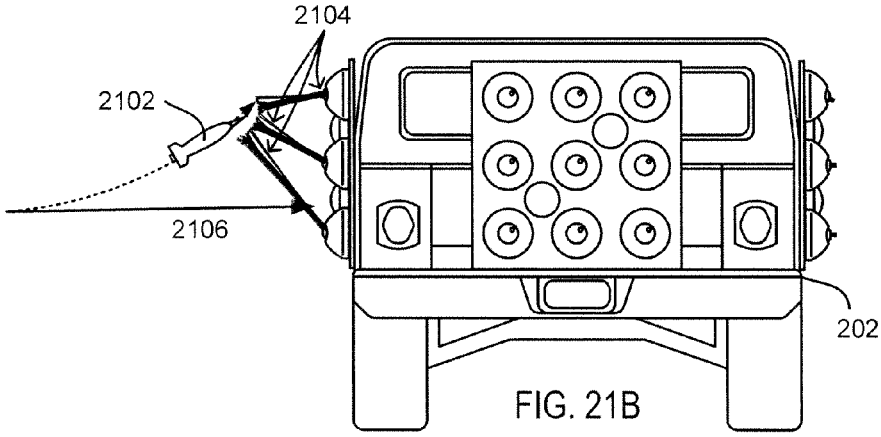
Figure 21C:
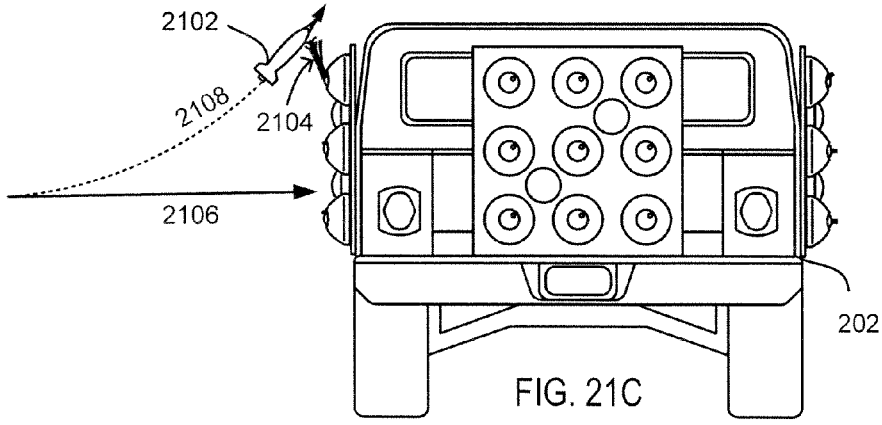

FIGS. 21A-21C are rear views illustrating deflection of a warhead 2102 originating to the left of a vehicle 202. The vehicle 202 includes a deflection system 100 similar to that discussed in relation to FIGS. 4, 19A-19C, and 20A-20C. FIG. 21A illustrates an incoming warhead 2102 being deflected by exhaust streams 2104. The warhead 2102 may be a rocket propelled grenade, artillery round, or any other explosive projectile. The warhead 2102 was fired with an original trajectory 2106 that was incident to the vehicle 202. The rockets 110 are shown producing exhaust streams 2104 which are aimed to deflect the warhead 2102 from its original trajectory 2106.

FIG. 21B illustrates the warhead 2102 as it has moved and been further deflected by the exhaust streams 2104. The exhaust streams 2104 and rockets 2104 have been adjusted to be aimed in the direction of the warhead 2104. FIG. 21C illustrates the warhead 2102 sufficiently deflected such that it will miss or only graze a side of the vehicle 202. The original trajectory 2106 and the deflected trajectory 2108 are depicted.

Figure 22:
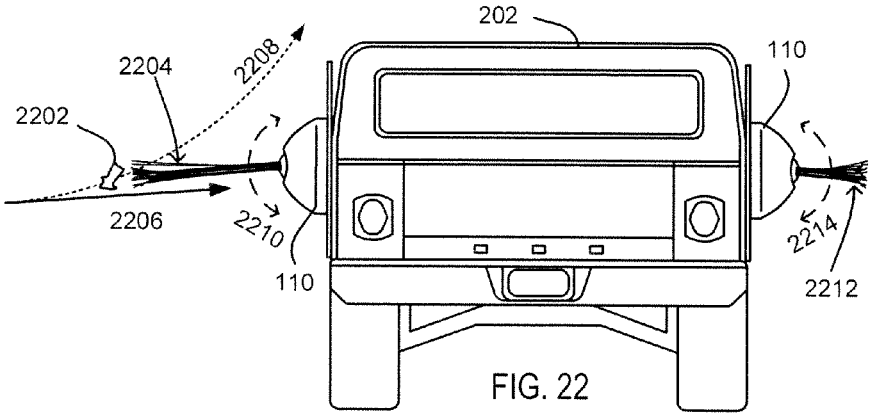
FIG. 22 is a rear view illustrating an example of deflection of a projectile using a single rocket.

FIG. 22 illustrates a projectile 2202 being deflected using a single aimable rocket 110, similar to the rocket 110 of FIG. 5. The projectile 2204 is being deflected by the exhaust stream 2204 produced by the rocket 110 from a first trajectory 2206 to a second trajectory 2208. In one embodiment, the rocket 110 is movable as indicated by arrow 2210 to point the exhaust stream 2204 to track the projectile 2202. In one embodiment, the exhaust stream 2204 produces the second trajectory 2208.

In one embodiment, an additional exhaust stream 2212 may be produced by a rocket 110 located on an opposite side of the vehicle 202. The additional exhaust stream 2212 may produce a thrust vector to oppose the thrust vector of the exhaust stream 2204. The opposing thrust vector may reduce or eliminate torque or force on the vehicle 202, which may cause the vehicle 202 to be moved by the rocket 110. In one embodiment, the additional exhaust stream 2212 may be steerable and may be adjusted to mirror the direction, exhaust flow rate, and/or divergence of the exhaust stream 2204.

In one embodiment, the rockets 110 are not sufficiently powerful to cause significant, or even measurable, movement of the vehicle 202. For example, the vehicle 202 may be so heavy and the friction between the vehicle 202 and the road may limit any movement of the vehicle. In one embodiment, more powerful rockets 110 and/or lighter vehicles 202 may result in actual movement or rotation of the vehicle 202, which may be undesirable. In one scenario, even a heavy moving land vehicle 202 may be more susceptible to thrust from rockets 110 when the vehicle is moving. In one embodiment, an air or water vehicle may be more susceptible to thrust produced by a rocket 110.

Figure 23:
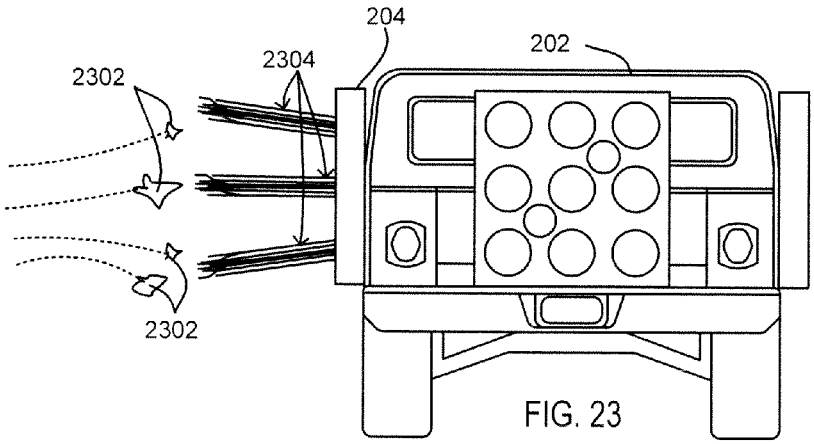
FIG. 23 is a rear view illustrating an example of deflection of a plurality of projectiles.

FIG. 23 illustrates one embodiment of deflection of a group of projectiles 2302 using a panel 204 with fixed rockets. In one embodiment, the panel 204 may be similar to the panels 204 of the deflection system of FIGS. 2 and 3. Exhaust streams 2304 produced by rockets within the panel 204 are shown. The exhaust streams 2304 are shown slowing and/or deflecting incoming projectiles 2302 to avoid and/or reduce damage caused by the projectiles 2303. In one embodiment, the exhaust streams 2304 are not adjustable but work together to deflect one or more of the projectiles 2302.

Figure 25:
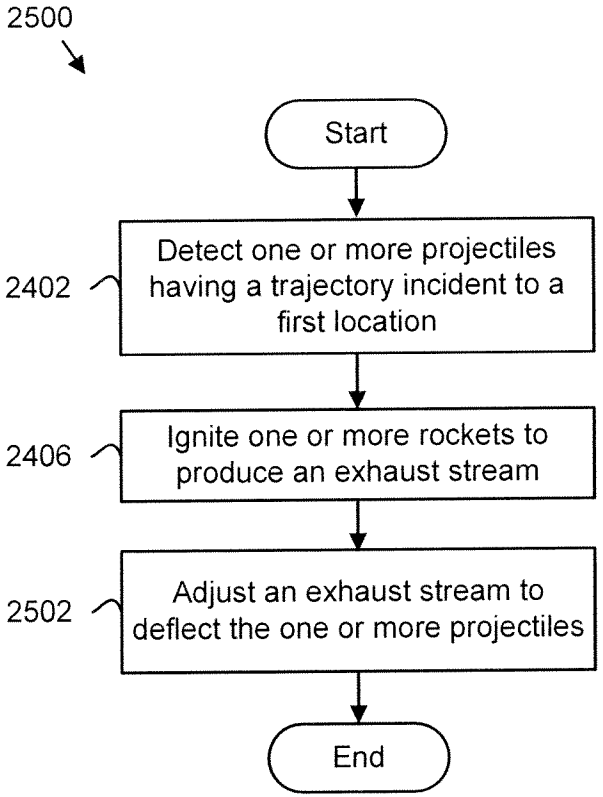
FIG. 25 illustrates a flow chart of another embodiment of a method for deflecting one or more projectiles.
Figure 24:
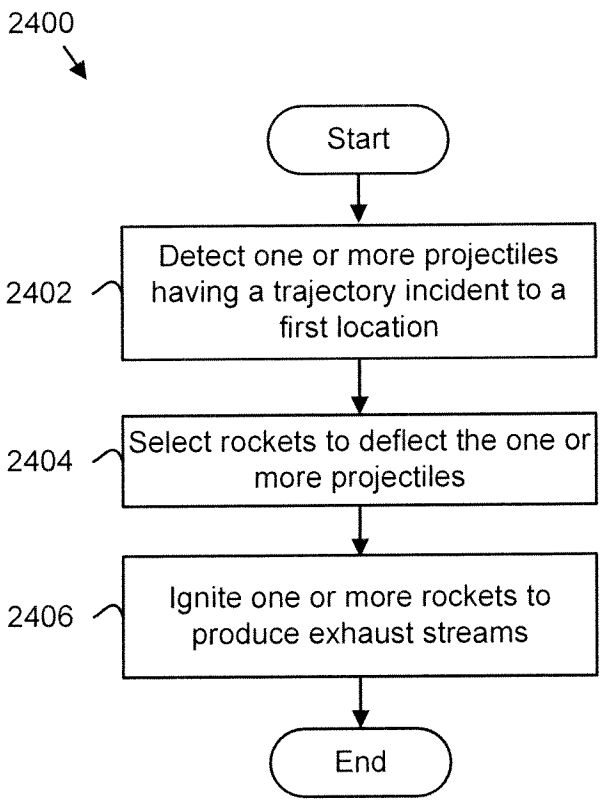
FIG. 24 illustrates a flow chart of one embodiment of a method for deflecting one or more projectiles.
Figure 26:
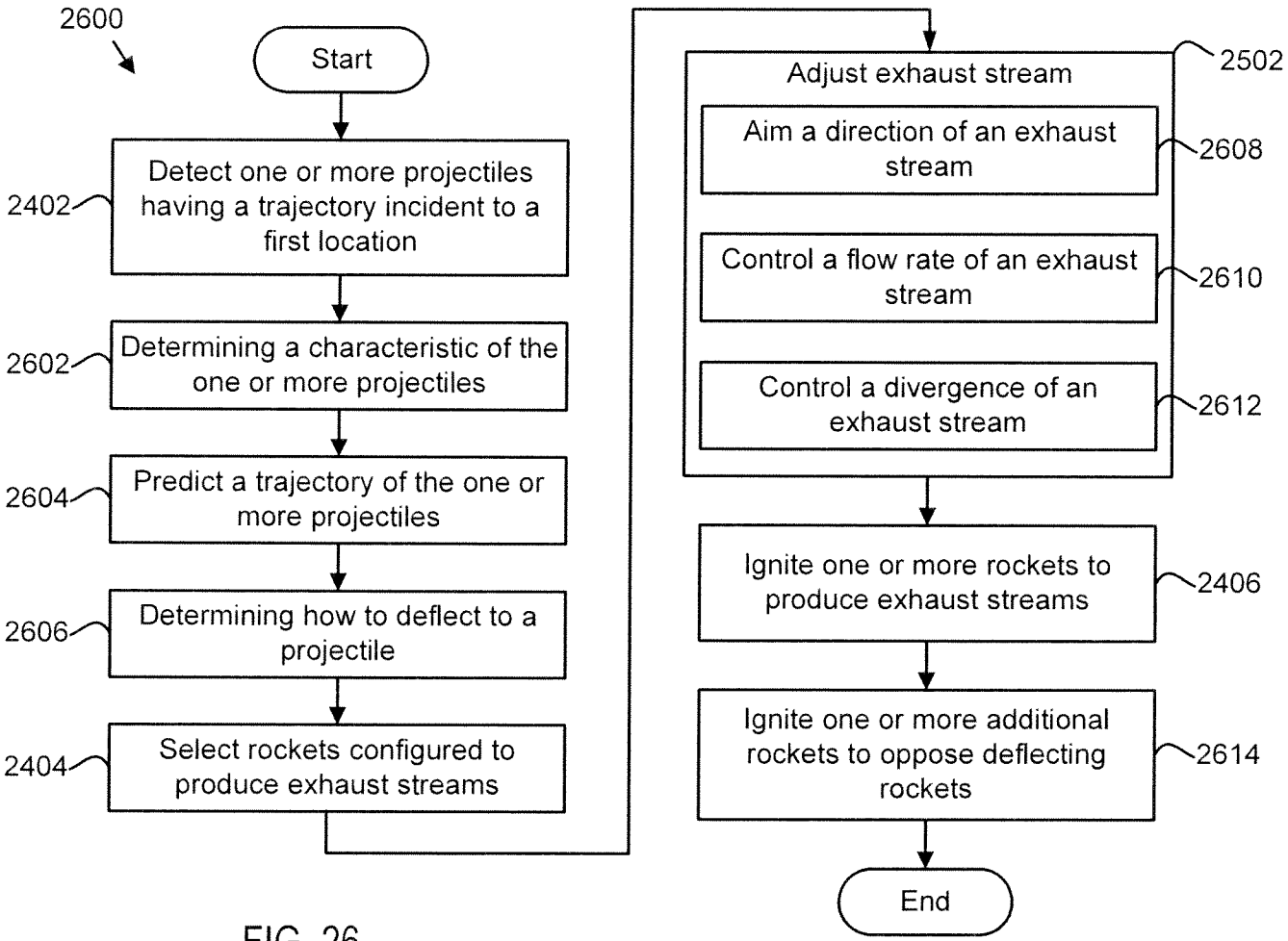
FIG. 26 illustrates a flow chart of another embodiment of a method for deflecting one or more projectiles.

FIGS. 24-26 illustrate methods for deflecting projectiles. FIG. 24 is a schematic flow chart diagram illustrating one embodiment of a method 2400 for deflecting projectiles. The method 2400 may be performed by a deflection system 100 with any of the variations discussed herein. For example, any of the deflection systems 100 of FIGS. 1-5 may implement the method 2400. In one embodiment, the method 2400 is performed by a deflection system 100 that includes two or more rockets.

The method 2400 may include the detection component 102 detecting 2402 one or more projectiles. The detection component 102 may detect 2402 projectiles that have a trajectory incident to a first location. The first location may include a location on a target that is to be protected. In one embodiment, the target that is to be protected includes a mobile target such as a vehicle. Example vehicles include land vehicles, air vehicles, and water vehicles. In one embodiment, the target that is to be protected includes a stationary target, such as a building or geographic location. According to one embodiment, the first location is a sensitive portion of a target. For example, the first location may include a weak point in the armor of a vehicle or a portion of a vehicle where people, or important systems or objects are located.

The method 2400 may include the selection component 104 selecting 2404 rockets that are configured to produce exhaust streams. In one embodiment, the selection component 104 selects two or more rockets that are mounted on a target. For example, the target may include a vehicle and the two or more rockets may be mounted on the vehicle. In one embodiment, the selection component 104 selects 2404 rockets that, when ignited, produce one or more exhaust streams configured to deflect the detected 2402 projectiles. According to one embodiment, the selection component 104 selects 2404 rockets that will deflect the projectiles from a first trajectory incident to a first location on a vehicle to a second trajectory that is not incident to the first location. For example, the rockets deflect the projectiles form impacting a cab of a vehicle to impacting another portion of the vehicle.

The method 2400 may include the ignition component 106 igniting 2406 one or more rockets to produce the exhaust streams that deflect the projectiles. In one embodiment, the ignition component 106 ignites 2406 the rockets selected 2404 by the selection component 104. The ignition component 106 may ignite 2406 the rockets by providing an electric ignition signal that ignites the rockets.

The above steps 2402-2406 are given by way of example only. Any of the variations discussed in relation to detection of projectiles, selection or rockets, and ignition of rockets as discussed in the present disclosure may be applied to the method 2400 of FIG. 4. Furthermore, one of skill in the art will recognize considerable variation beyond the embodiments disclosed herein that falls within the scope of the present disclosure.

FIG. 25 is a schematic flow chart diagram illustrating one embodiment of a method 2500 for deflecting projectiles. The method 2500 may be performed by a deflection system 100 with any of the variations discussed herein. For example, any of the deflection systems 100 of FIGS. 1-5 may implement the method 2500. In one embodiment, the method 2500 may be performed by a deflection system 100 that includes two or more rockets. Similar to FIG. 24, the method 2500 includes the detection component 102 detecting 2402 one or more projectiles and the ignition component 106 igniting 2406 one or more rockets. Any of the variations discussed above in relation to detection 2402 or ignition 2406 may also be included within method 2500. However, the method 2500 is depicted without the selection 2404 step by way of example only.

Method 2500 may include the adjustment component 108 adjusting 2502 an exhaust stream to deflect one or more projectiles. In one embodiment, the adjustment component 108 adjusts 2502 the exhaust stream to deflect the one or more projectiles from a first trajectory incident to a first location to a second trajectory not incident to the first location. The first location may be a location on a vehicle and the second trajectory may be incident to a location not on the vehicle. The first location may be a sensitive location of a vehicle and the second location may be incident to another location of the vehicle.

In one embodiment, the adjustment component 108 adjusts 2502 an exhaust stream by aiming a direction of the exhaust stream. For example, the adjustment component 108 may point an exhaust stream towards a deflected projectile. In one embodiment, the adjustment component 108 aims the direction of an exhaust stream using an exhaust deflector, an exhaust coupler, a variable exhaust nozzle, a gimbaled rocket, or the like.

In one embodiment, the adjustment component 108 adjusts 2505 an exhaust stream by controlling a flow rate or a momentum flux of an exhaust stream. For example, the adjustment component 108 may control how quickly a propellant of a rocket is burned. The adjustment component 108 may control the number of rockets whose exhaust is combined to produce a single exhaust stream. For example, the rocket exhaust may be combined through an exhaust coupler and the adjustment component 108 may control how many of the rockets are ignited.

In one embodiment, the adjustment component 108 adjusts 2505 an exhaust stream by controlling a divergence of the exhaust stream. For example, the adjustment component 108 may control a divergence using a variable exhaust nozzle or a nozzle insert.

Once again, the steps 2402, 2406, and 2502 of method 2500 are given by way of example only. Any of the variations discussed within the present disclosure may be included in method 2500, without limitation.

FIG. 26 is a schematic flow chart illustrating yet another embodiment of a method 2600 for deflecting projectiles. Similarly, the method 2600 may be performed by a deflection system 100 with any of the variations discussed herein. For example, any of the deflection systems 100 of FIGS. 1-5 may implement the method 2600. The method 2600 is depicted including steps 2402-2406 and 2502 as discussed in relation to the previous methods 2400 and 2500. According to one embodiment, any of the variations discussed in relation to methods 2400 and 2500 may be included in method 2600. In one embodiment, the method 2600 includes one or any combination of two or more of steps 2602-2614.

The method 2600 may include the detection component 102 detecting 2402 a projectile having a trajectory that is incident to a first location.

The method 2600 may include the detection component 102 determining 2602 a characteristic of the one or more projectiles. In one embodiment, the detection component 102 determines 2602 one or more characteristics of a projectile based on a detector used. For example, radar signatures, lidar signatures, images, or other information gathered through a detector may be used by the detection component 102 to determine one or more characteristics. Examples of characteristics include size, velocity, location, projectile type, distribution of a plurality of projectiles, or the like.

The method 2600 may include the prediction component 112 predicting 2604 a trajectory of a projectile. In one embodiment, the detection component 102 may include a prediction component 112 that predicts 2604 a trajectory of one or more projectiles based on information obtained by the detection component 102. For example, the prediction component 112 may predict 2604 a trajectory based on a characteristic determined by the detection component. The prediction component 112 may receive size, velocity, and location information and perform one or more calculations to predict the trajectory of the projectile.

In one embodiment, the prediction component 112 determines whether the projectile has a trajectory incident to a target or a sensitive location of a target. The prediction component 112 may control whether a deflection system takes any steps to deflect a projectile. For example, the prediction component 112 may determine that a projectile will miss a vehicle and determine that the projectile should be ignored.

The method 2600 may include the selection component 104 and/or the adjustment component 108 determining 2606 how to deflect a projectile. In one embodiment, the selection component 104 and/or the adjustment component 108 determines 2606 how to deflect a projectile based on one or more characteristics of the projectile(s) and/or one or more characteristics of available rockets 110. For example, determining 2606 how to deflect a projectile may be based upon a size, type, and/or velocity of a projectile. As another example, determining 2606 how to deflect a projectile may be based on a location, direction, exhaust flow rate or flux momentum, or divergence of a rocket or exhaust stream.

In one embodiment, determining 2606 how to deflect a projectile includes determining a new trajectory that is not incident to a first location on a target, such as a vehicle. Determining 2606 how to deflect a projectile may include determining an amount of momentum necessary to deflect a projectile from a first trajectory, or original trajectory. Determining 2606 how to deflect a projectile may include determining which of a plurality of rockets can affect the trajectory of the projectile. In one embodiment, determining 2609 how to deflect a projectile includes determining how to adjust an exhaust stream to effectively affect the trajectory of a projectile.

The method 2600 may include the selection component 104 automatically selecting 2404 rockets configured to produce exhaust stream. The method 2600 may include the adjustment component 108 adjusting 2502 an exhaust stream. In one embodiment, adjusting 502 the exhaust stream includes the adjustment component 108 aiming 2608 a direction of an exhaust stream. In one embodiment, adjusting 502 the exhaust stream includes the adjustment component 108 controlling 2610 a flow rate or a flux momentum of an exhaust stream. In one embodiment, adjusting 502 the exhaust stream includes the adjustment component 108 controlling 2612 a divergence of an exhaust stream. The method 2600 may include igniting 2406 one or more rockets to produce exhaust streams 2406. Once again, any of the variations in selecting 2404, adjusting 2502, or igniting 2406 discussed above in relation to methods 2400 and 2500 or elsewhere in the application may be included within method 2600.

The method 2600 may include igniting 2614 one or more additional rockets to oppose any thrust produced by the deflecting rockets, or rockets that produce exhaust that deflects a projectile. In one embodiment, the rockets ignited 2406 to deflect one or more projectiles may produce a first thrust vector. The first thrust vector may move or affect movement of an object on which the rockets are mounted. In one embodiment, the first thrust vector is large enough to create risk of damage or injury to a vehicle or its occupants. One or more additional rockets may be ignited 2614 to produce a second thrust vector that at least partially counteracts the first thrust vector. In one embodiment, the second thrust vector is opposite in direction to the first thrust vector. In one embodiment, the second thrust vector is the same in magnitude as the second thrust vector. In one embodiment, the second thrust vector is configured to have a direction and/or magnitude to counteract any torque or force produced by the first thrust vector.

According to one embodiment, the methods 2400, 2500, and 2600 may provide utility in deflection of projectiles. However, other benefits may also exist and are considered within the scope of the present disclosure. For example, complete deflection of a projectile may not be necessary to reduce or stop damage to a target. For example, exhaust may sufficiently slow a projectile such that any damage is limited or minimal even if the projectile still impacts the target or even a sensitive location on the target. Additionally, damage to the projectile may also occur which may further limit any damage to the target. For example, a projectile may be softened or deformed by hot exhaust and may cause the projectile to fail to penetrate into a target. Similarly, explosive warheads may be damaged such that they do not explode or explode in a way that the warhead is not as effective in damaging a target.

Further variations include that the rockets may not be mounted on a target that is to be protected but may be mounted nearby. For example, rockets mounted on a vehicle may be used to protect another vehicle, a geographic location, or a building. Similarly, the rockets may be mounted at a fixed location, such as on a building or at a geographic location. Another possible variation includes that exhaust is produced by an exhaust generator other than a rocket. For example, various engines, explosives, or other device that produce a jet or a flow of exhaust may be used in some embodiments.

This disclosure has been made with reference to various example embodiments including the best mode. However, those skilled in the art will recognize that changes and modifications may be made to the embodiments without departing from the scope of the present disclosure. For example, various operational steps, as well as components for carrying out operational steps, may be implemented in alternate ways depending upon the particular application or in consideration of any number of cost functions associated with the operation of the system, e.g., one or more of the steps may be deleted, modified, or combined with other steps.

Additionally, as will be appreciated by one of ordinary skill in the art, principles of the present disclosure may be reflected in a computer program product on a computer-readable storage medium having computer-readable program code means embodied in the storage medium. Any tangible, non-transitory computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create a means for implementing the functions specified. These computer program instructions may also be stored in a computer-readable memory that can direct a computer or other programmable data processing apparatus to function in a particular manner, such that the instructions stored in the computer-readable memory produce an article of manufacture, including implementing means that implement the function specified. The computer program instructions may also be loaded onto a computer or other programmable data processing apparatus to cause a series of operational steps to be performed on the computer or other programmable apparatus to produce a computer-implemented process, such that the instructions that execute on the computer or other programmable apparatus provide steps for implementing the functions specified.

While the principles of this disclosure have been shown in various embodiments, many modifications of structure, arrangements, proportions, elements, materials, and components, which are particularly adapted for a specific environment and operating requirements, may be used without departing from the principles and scope of this disclosure. These and other changes or modifications are intended to be included within the scope of the present disclosure.

The foregoing specification has been described with reference to various embodiments. However, one of ordinary skill in the art will appreciate that various modifications and changes can be made without departing from the scope of the present disclosure. Accordingly, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, a required, or an essential feature or element. As used herein, the terms "comprises," "comprising," and any other variation thereof, are intended to cover a non-exclusive inclusion, such that a process, a method, an article, or an apparatus that comprises a list of elements does not include only those elements but may include other elements not expressly listed or inherent to such process, method, system, article, or apparatus. Also, as used herein, the terms "coupled," "coupling," and any other variation thereof are intended to cover a physical connection, an electrical connection, a magnetic connection, an optical connection, a communicative connection, a functional connection, and/or any other connection.

Those having skill in the art will appreciate that many changes may be made to the details of the above-described embodiments without departing from the underlying principles of the invention. The scope of the present invention should, therefore, be determined only by the following claims.

What is claimed is:

1. A system for protecting a vehicle from projectiles, the system comprising:

a detection component to detect one or more projectiles having a first trajectory that is incident to a first location on the vehicle;

a selection component to automatically select two or more rockets mounted on the vehicle that, when ignited, produce a plurality of exhaust streams configured to deflect the one or more projectiles to a second trajectory that is not incident to the first location on the vehicle, wherein each of the plurality of exhaust streams affect a trajectory of a same projectile of the one or more projectiles; and an ignition component to ignite the selected two or more rockets;

wherein the selection component selects a first rocket to create a first exhaust stream in a first direction and selects a second rocket to create a second exhaust stream in a second direction, wherein the first rocket and the second rocket comprise fixed orientations, wherein the direction of the second exhaust stream is at least partially orthogonal to the direction of the first exhaust stream, and wherein the first rocket and the second rocket are positioned such that, when burning at the same time, the first exhaust stream and second exhaust stream combine to create a combined exhaust stream to deflect the one or more projectiles.

2. The system of claim 1, wherein the two or more rockets are selected to provide momentum to the one or more projectiles in a direction at least partially orthogonal to the first trajectory.

3. The system of claim 1, wherein the selection component selects two or more rockets based on a momentum flux of the exhaust stream of each rocket.

4. The system of claim 1, wherein the selection component selects at least two rockets whose exhaust streams are combined through an exhaust coupler.

5. The system of claim 4, the system further comprising the exhaust coupler.

6. The system of claim 1, wherein the selection component selects two or more rockets based on a specific impulse of each rocket.

7. The system of claim 1, wherein the selection component selects two or more rockets based on a divergence of exhaust for each rocket.

8. The system of claim 1, wherein the selection component selects a first rocket from a first group of rockets in a first region of the vehicle and selects a second rocket from a second group of rockets in a second region of the vehicle.

9. The system of claim 1, the system further comprising a collection of rockets, the collection of rockets comprising the selected two or more rockets and wherein each rocket of the collection of rockets is independently selectable by the selection component.

10. The system of claim 9, wherein a rocket of the collection of rockets comprises a solid fuel.

11. The system of claim 10, wherein the selection component selects a rocket comprising layers of fuel having varying combustion rates.

12. The system of claim 1, wherein the detection component determines a distribution of projectiles.

13. The system of claim 12, wherein the selection component selects a rocket having an exhaust stream with a higher divergence when the projectiles have a wider distribution.

14. The system of claim 1, wherein the detection component determines that the one or more projectiles comprise a debris cloud.

15. The system of claim 1, wherein the detection component determines that the one or more projectiles comprise shrapnel.

16. The system of claim 1, wherein the detection component comprises a radar unit.

17. The system of claim 1, wherein the detection component comprises a light detection and ranging (LIDAR) unit.

18. The system of claim 1, wherein the detection component comprises an electromagnetic antenna.

19. The system of claim 1, wherein the detection component detects electromagnetic radiation generated by an electric trigger signal on an explosive device.

20. A method for protecting a vehicle from projectiles, the method comprising:

detecting, using a data processing apparatus, one or more projectiles having a first trajectory that is incident to a first location on the vehicle;

automatically selecting, using the data processing apparatus, two or more rockets mounted on the vehicle that, when ignited, produce a plurality of exhaust streams configured to deflect the one or more projectiles to a second trajectory that is not incident to the first location on the vehicle, wherein each of the plurality of exhaust streams affect a trajectory of a same projectile of the one or more projectiles; and igniting the selected two or more rockets;

wherein the selecting the two or more rockets comprises selecting a first rocket to create a first exhaust stream in a first direction and selecting a second rocket to create a second exhaust stream in a second direction, wherein the first rocket and the second rocket comprise fixed orientations, wherein the direction of the second exhaust stream is at least partially orthogonal to the direction of the first exhaust stream, and wherein the first rocket and the second rocket are positioned such that, when burning at the same time, the first exhaust stream and second exhaust stream combine to create a combined exhaust stream to deflect the one or more projectiles.

21. The method of claim 20, wherein the second trajectory is incident to a second location on the vehicle, wherein the second location comprises a less sensitive location of the vehicle.

22. The method of claim 20, wherein the second trajectory is not incident to the vehicle.

23. The method of claim 20, wherein selecting comprises selecting two or more rockets to produce exhaust streams configured to impact the one or more projectiles at different times.

24. The method of claim 23, wherein igniting comprises igniting a first rocket earlier in time than a second rocket.

25. The method of claim 20, wherein selecting comprises predicting a time at which a projectile will pass through an exhaust stream produced by the first rocket and/or the second rocket.

26. The method of claim 20, wherein detecting comprises predicting the first trajectory.

27. The method of claim 26, wherein predicting comprises predicting the first trajectory based on a location of an explosion event.

28. The method of claim 26, wherein predicting comprises predicting the first trajectory based on a location of the one or more projectiles.

29. The method of claim 26, wherein predicting comprises predicting the first trajectory based on a velocity of the one or more projectiles.

30. The method of claim 26, wherein predicting comprises predicting the first trajectory based on a projectile type of the one or more projectiles.

31. A computer-readable storage medium comprising program code to perform a method comprising:

detecting one or more projectiles having a first trajectory that is incident to a first location on the vehicle;

automatically selecting two or more rockets mounted on the vehicle that, when ignited, produce a plurality of exhaust streams configured to deflect the one or more projectiles to a second trajectory that is not incident to the first location on the vehicle, wherein each of the plurality of exhaust streams affect a trajectory of a same projectile of the one or more projectiles; and igniting the selected two or more rockets;

wherein the selecting the two or more rockets comprises selecting a first rocket to create a first exhaust stream in a first direction and selecting a second rocket to create a second exhaust stream in a second direction, wherein the first rocket and the second rocket comprise fixed orientations, wherein the direction of the second exhaust stream is at least partially orthogonal to the direction of the first exhaust stream, and wherein the first rocket and the second rocket are positioned such that, when burning at the same time, the first exhaust stream and second exhaust stream combine to create a combined exhaust stream to deflect the one or more projectiles.

* * * * *